United States Patent [19]

Kaneko et al.

[11] Patent Number: 4,651,310

[45] Date of Patent: Mar. 17, 1987

[54] POLYMERIC PIEZOELECTRIC ULTRASONIC PROBE

[75] Inventors: Nagao Kaneko, Yokohama; Nanao Nakamura, Kawasaki; Masao Koyama, Yokohama; Shiroh Saitoh, Yokohama; Hiroki Honda, Yokohama, all of Japan

[73] Assignee: Kabushiki Kaisha Toshiba, Kawasaki, Japan

[21] Appl. No.: 809,337

[22] Filed: Dec. 16, 1985

[30] Foreign Application Priority Data

Dec. 18, 1984 [JP] Japan ..... 59-265295

[51] Int. Cl.[4] ..... H04R 17/00

[52] U.S. Cl. ..... 367/140; 310/311; 310/325; 310/359; 310/800

[58] Field of Search ..... 367/155, 157, 164, 140; 310/311, 325, 357, 359, 800, 317, 331, 366

[56] References Cited

U.S. PATENT DOCUMENTS

| | | | |
|---|---|---|---|
| 3,401,377 | 9/1968 | Bartlett et al. | 310/359 X |
| 3,943,614 | 3/1976 | Yoshikawa et al. | 310/800 X |
| 3,980,905 | 9/1976 | Miller | 310/317 |
| 4,054,808 | 10/1977 | Tanaka | 310/366 X |
| 4,383,194 | 5/1983 | Ohigashi et al. | 310/800 X |
| 4,385,255 | 5/1983 | Yamaguchi et al. | 310/366 |

FOREIGN PATENT DOCUMENTS

| | | |
|---|---|---|
| 0094078 | 11/1983 | European Pat. Off. . |
| 54-29878 | 9/1979 | Japan . |
| 56-47199 | 4/1981 | Japan . |
| 56-101789 | 8/1981 | Japan . |
| 58-7998 | 1/1983 | Japan . |

*Primary Examiner*—Charles T. Jordan
*Assistant Examiner*—John W. Eldred
*Attorney, Agent, or Firm*—Schwartz, Jeffery, Schwaab, Mack, Blumenthal & Evans

[57] ABSTRACT

There is disclosed a polymeric piezoelectric ultrasonic probe using a polymeric piezoelectric member which comprises a polymeric piezoelectric member; a common electrode formed on one surface of the polymeric piezoelectric member; and electrodes for driving provided as opposed to the common electrode with the polymeric piezoelectric member being interposed therebetween, the electrodes for driving being formed on a polymeric thin film.

The polymeric piezoelectric ultrasonic probe of the present invention has advantages that not only breaking or short circuit of electrodes shaped in rectangular strips can be prevented, but also it becomes possible to connect lead wires with good reliability. Besides, not only cumbersomeness is registration of electrodes shaped in rectangular strips during lamination of polymeric piezoelectric members can be cancelled, but also acoustic-electrical coupling or cross-talk can be reduced.

18 Claims, 60 Drawing Figures

POLYMERIC PIEZOELECTRIC ULTRASONIC PROBE

BACKGROUND OF THE INVENTION

This invention relates to an ultrasonic probe with the use of a polymeric piezoelectric member as a vibrator.

In the prior art, as a linear array type ultrasonic probe used, for example, in a linear electron scanning system, one employed an array having a ceramic piezoelectric member such as lead titanate, lead titanate-zirconate, etc. cut into rectangular strips. (See for example, J. F. Havlice and J. C. Tazer, "Medical Ultrasonic Imaging: An Overview of Principles and Instrumentation", Proc. IEEE Vol. 67, p. 620 (1979) and A. Fukumoto, "The Application of Piezoelectric Ceramics in Diagnostic Ultrasound Transducer", Ferroelectrics, Vol. 40, p. 217 (1982)). However, such a ceramic piezoelectric member has rigid and brittle properties, is prone to generation of defects or fractures during dividing by cutting, and difficulties are encountered in precise formation of a number of electrodes shaped in rectangular strips, whereby, problems arise from the cost aspect as well.

In contrast, fluorine containing polymers such as polyvinylidene fluoride (hereinafter abbreviated as $PVF_2$), polyvinylidene fluoride-trifluoroethylene copolymer (hereinafter abbreviated as $PVF_2$.TrFE) and other polar synthetic polymers are known to exhibit piezoelectric property and pyroelectric property by being subjected to a polarizing treatment under high temperature and high electrical field. (See, for example, Y. Higashihata, J. Sako and T. Yagi, "Piezoelectricity of $PVF_2$.TrFE", Ferroelectrics, Vol. 32, pp. 85–92, (1981)). Also, development of the ultrasonic probe utilizing thickness vibration of the aforesaid polymeric piezoelectric member has been actively done in recent years. Such a polymeric piezoelectric member has an inherent acoustic impedance which is approximate to that of water or a living body and also small in modulus, and therefore, when a polymeric piezoelectric member is applied for a linear array type ultrasonic probe, as different from the example of a ceramic piezoelectric member, it is said that the polymeric piezoelectric member itself is not necessarily required to be cut and separated into rectangular strips and is required to be separated only as an electrode.

However, the dielectric constant of a polymeric piezoelectric member is markedly smaller as compared with a ceramic piezoelectric member, namely in the order of generally about 10, and also due to the small area of the driving element of the linear array type ultrasonic probe the, electrical impedance becomes markedly higher, whereby electrical matching with a 50 Ω system power source (sending and receiving circuits) is ordinarily poor which results in a marked loss and lowering of the ultrasonic wave.

For such reasons as mentioned above the, usefulness of a so-called laminated piezoelectric ultrasonic probe, in which a plurality of polymeric piezoelectric members are laminated appropriately so that the polarized axis directions may be opposed to each other, has been investigated (for example, Japanese Provisional Patent Publications No. 151893/1980 and No. 47199/1981). Such a laminated polymeric piezoelectric member is laminated by adhering two sheets of polymeric piezoelectric members having, for example, a film thickness t under the state with an electrode interposed therebetween so that the polarized axis directions may be opposed to each other. On one surface of such a laminated polymeric piezoelectric member is provided an acoustic reflective plate (λ/4 plate), connecting the piezoelectric member to the electrode of the same direction as the polarized axis direction. Upon applying voltage pulses, etc. thereon, excitation of an ultrasonic wave conforming to the basic mode of:

$$\lambda/4=2t\ (\lambda=8t)$$

becomes possible. That is, as compared with the case of constituting the polymeric piezoelectric member of one sheet with a film thickness of 2t, the electrical capacity of the polymeric piezoelectric member becomes 4-fold resulting in an electrical impedance of ¼.

However in an ultrasonic probe with such a structure, during lamination of the polymeric piezoelectric, members, electrodes shaped in rectangular strips can only be accurately made in conformity to each other with difficulty, and deviation in position is liable to occur between the upper and lower electrodes. With occurence of such a deviation in position, not only does the electrical impedance of the polymeric piezoelectric member previously designed fail to exhibit its initial characteristics, but also the output ultrasonic wave beomces non-uniform due to non-uniformity of the thickness vibration mode, etc. and simultaneously there occurs generation of acoustic-electrical coupling or cross-talk, whereby sensitivity may be lowered or the band region narrowed, even resulting in generation of a short circuit between the driving elements. This problem becomes more marked as the number of the polymeric piezoelectric members is increased.

On the other hand, the electrodes shaped in rectangular strips are generally of a miniature size, and can be formed by vapor deposition or patterning of a metal film according to the vapor deposition method, the sputtering method, etc. However, if the film thickness of the metal film constituting the electrodes is thin, the electrical resistance becomes high to cause loss of the voltage driving pulses. Also, during lamination of the polymeric piezoelectric members, when lamination is effected by folding one continuous polymeric piezoelectric material, there is the danger that electrodes shaped in rectangular strips may be broken.

Also, since the aforesaid electrodes shaped in rectangular strips form an inherent electrode pattern on a polymeric piezoelectric member, it is very cumbersome to take out the lead wires from the electrodes. For example, in taking out lead wires from the electrodes shaped in rectangular strips which have been obtained by working the electrode imparted on the whole surface by vacuum vapor deposition on a polymeric piezoelectric member by etching into rectangular strips, it is impossible to take out lead wires by direct soldering of lead wires because of softening of the polymeric piezoelectric member (in the case of $PVF_2$, a softening point of about 170° C.) or depolarization. For this reason, for example, there is employed the method wherein the lead wires are taken out while securing the lead wires with the use of a so-called electroconductive adhesive or an electroconductive paint in which electroconductive powder such as silver powder is mixed into an adhesive. However, in such a method, there are involved the problems such that short circuit of electrodes shaped in rectangular strips through the electroconductive adhesive or the electroconductive paint or peel-off of the lead wire secured portion will readily occur, and also that changes with lapse of time occur such as the lowering in securing force and elevation in resistance value.

Since the dielectric constant of the polymeric piezoelectric member is generally small in the order of 10 to some hundreds and is about several hundredth to several tenth as compared with a ceramic piezoelectric member with several thousands or so, in case of the array type ultrasonic probe having a small driving surface per one element, electrical impedance becomes markedly higher. Thus, there are problems that electrical matching with an usual 50 Ω driving circuit or a receiving circuit is difficult whereby the charateristics of the ultrasonic probe will be deteriorated.

Further, since the polymeric piezoelectric member has a high electrical impedance as mentioned above, when it is used by connecting a coaxial cable of a 50 Ω or 75 Ω system, a length of a coating layer on a core wire of a cable to be connected and a length of a ground wire to be taken-out become a problem, and in certain circumstances, there occurs a problem of a so-called cross-talk phenomenon where other elements are to be driven.

SUMMARY OF THE INVENTION

An object of the present invention is to provide a polymeric piezoelectric ultrasonic probe which comprises a polymeric piezoelectric member, driving electrodes, and a common electrode, wherein said driving electrodes are formed on a polymeric film.

Another object of the present invention is to provide, in an ultrasonic probe which uses a polymeric piezoelectric member. The polymeric piezoelectric ultrasonic probe eliminates cumbersommeness of electrodes shaped in rectangular strips during, for example, lamination of polymeric piezoelectric members, is further excellent in reliability with very little acoustic-electrical coupling or cross-talk and also prevents breaking or short circuit of the electrodes in the rectangular strips, etc.

Further object of the present invention is to provide a polymeric piezoelectric ultrasonic probe in which take-out of lead wires from the common electrode is done very simply without suffering from restriction in space and is consequently small in variance of characteristics.

A still further object of the present invention is to provide, in an ultrasonic probe using a polymeric piezoelectric member, a polymeric piezoelectric ultrasonic probe having excellent sensitivity, band region, etc. by selecting an inductor, a usable range of the inductance value and a setting up method of an inductor in order to adjust a high electrical impedance of the polymeric piezoelectric member with an impedance of a driving circuit by use of the inductor and further to prevent cross-talk and the like.

A still further object of the present invention is to provide, in an ultrasonic probe using a polymeric piezoelectric member, a polymeric piezoelectric ultrasonic probe which has prevented a cross-talk phenomenon of which other elements are driven, by regulating a length of a coating layer on a bared core wire of a coaxial cable to be connected and a length of a ground wire to be taken-out.

A polymeric piezoelectric ultrasonic probe using a polymeric piezoelectric member of the present invention comprises a polymeric piezoelectric member; a common electrode formed on one surface of said polymeric piezoelectric member; and electrodes for driving provided as opposed to said common electrode with said polymeric piezoelectric member being interposed therebetween, said electrodes for driving being formed on a polymeric thin film.

DESCRIPTION OF THE PREFERRED EMBODIMENTS

Figure 1:
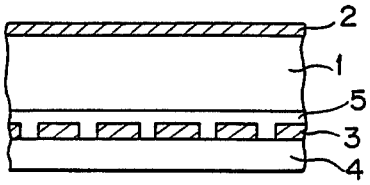
FIGS. 1 through 8 are schematic illustrations showing examples of the polymeric piezoelectric ultrasonic probe according to the present invention.

The polymeric piezoelectric member to be used in the present invention may include fluorine containing polymers such as $PVF_2$, $PVF_2$.TrFE or polyvinylidene fluoride.fluoroethylene copolymer, or polyvinylidene cyanide or its copolymer, polyacrylonitrile type copolymer or so-called composite polymeric piezoelectric materials in which a strongly dielectric ceramic such as powder of titanium zirconate, lead zirconate, etc. is mixed, and so on. As the material for the polymeric thin film on which electrodes for driving provided as opposed to the common electrode through the polymeric piezoelectric member, there may be employed polymeric materials capable of forming thin films such as polyester, polyethylene, poypropylene, polyimide, aromatic polyamide, polyether, polyvinyl chloride, $PVF_2$, $PVF_2$ type copolymer, polystyrene, etc., and the material is not particularly limited. These polymeric films can be made into thin films according to the known method such as the casting method, the extrusion roll method, etc.

The polymeric piezoelectric ultrasonic probe of the present invention is constituted by integrating acoustically the polymeric piezoelectric member having a common electrode thereon and the polymeric thin film having electrodes for driving formed thereon with the use of an adhesive, etc. As the common electrode, in certain cases, the electrode used in preparation of the piezoelectric member may also be utilized. Alternatively, similarly as the electrodes for driving, an electrode formed on a polymeric thin film may be integrated with the piezoelectric member with the use of an adhesive, etc. The acoustic impedances (Z) of the polymeric thin film and the adhesive should preferably be relatively near to the acoustic impedance ($Z_0$) of the polymeric piezoelectric member, and it is preferably selected from within the scope of $0.2<Z/Z_0<2$. This is because the polymeric piezoelectric member and the polymeric thin film together with the adhesive can exhibit an integral vibration. The polymeric thin film on which electrodes for driving are formed may have a film thickness which is not particularly limited. However, if it is too thick, the integral vibration with the polymeric piezoelectric member can cause difficulty resulting in increase of loss. On the other hand, if it is too thin, the operation such as setting up of the electrode and adhesion can be difficult. Thus, its film thickness may desirably be in the range from some μm to some ten μm. Further, the adhesive, etc. for adhering the polymeric piezoelectric member having a common electrode provided thereon with the polymeric thin film having electrodes for driving formed thereon should desirably have an acoustic impedance, hardness and a thicknes of the adhesive layer, etc. which should suitably be selected so that the polymeric piezoelectric member and the polymeric thin film may be acoustically integrated.

The electrodes for driving formed on the polymeric thin film to be used in the present invention are not particularly limited, and they can be formed by way of example such as vapor deposition or sputtering of, for example, gold, silver, nickel, aluminum, etc. and then working such as etching to form a desired shape, or alternatively by coating the polymeric thin film with a so-called electroconductive paint containing electroconductive powder such as silver powder mixed in an epoxy resin, etc. according to screen printing, etc.

The polymeric piezoelectric ultrasonic probe comprising the polymeric thin film having electrodes for driving thus previously formed thereon secured on the polymeric piezoelectric member not only cancels the cumbersomeness in registration of electrodes in the shape of rectangular strips during lamination as in the prior art, but also can reduce acoustic-electrical coupling or cross-talk due to registration of electrodes with high precision. Also, in some cases, by providing a $\lambda/4$ plate on the side opposite to the acoustic actuating side, efficiency can be enhanced. Further, when the electrodes are on the acoustic actuating side and electrical leak or generation of noise occurs, a common electrode can be further provided on the entire surface at the outside of the polymeric thin film and grounded for prevention of such problems.

In the following, specific examples of the polymeric piezoelectric ultrasonic probe are described by referring to schematic illustrations shown in FIG. 1 through FIG. 8. In respective Figures in FIG. 1 through FIG. 8, the upper part of the Figure is the side on which the acoustic propagating member is positioned, which corresponds to the acoustic actuating side.

Figure 2:
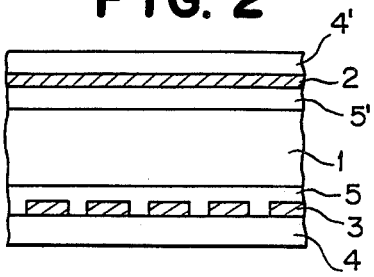
Figure 3:
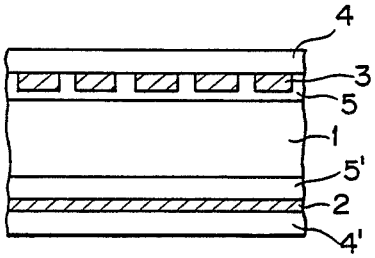

FIG. 1 through FIG. 3 are schematic illustrations showing examples of $\lambda/2$ driving type polymeric piezoelectric ultrasonic probe. In the probe shown in FIG. 1, a common electrode 2 is provided by vapor deposition, etc. on the acoustic actuating side of a polymeric piezoelectric member 1, while, i.e., the acoustic non-actuating side on the other side, is provided through an intermediary adhesive layer 5 a polymeric thin film 4 having electrodes for driving 3 formed thereon. In the probe shown in FIG. 2, on the acoustic actuating side of a polymeric piezoelectric member 1 is provided through an intermediary adhesive layer 5' a polymeric thin film 4' having a common electrode 2 formed thereon, while on the acoustic non-actuating side is provided through an intermediary adhesive layer 5 a polymeric thin film 4 having electrodes for driving 3 formed thereon. The probe shown in FIG. 3 is an example in which the constituent members are provided in the order opposite to that in FIG. 2.

Figure 4:
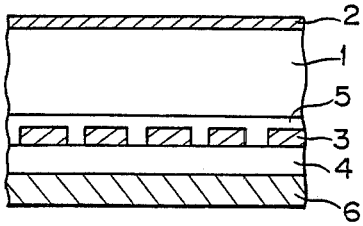
Figure 5:
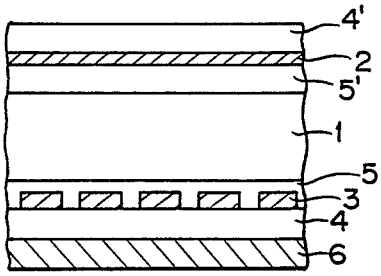
Figure 6:
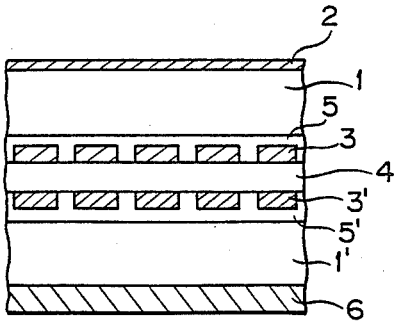
Figure 7:
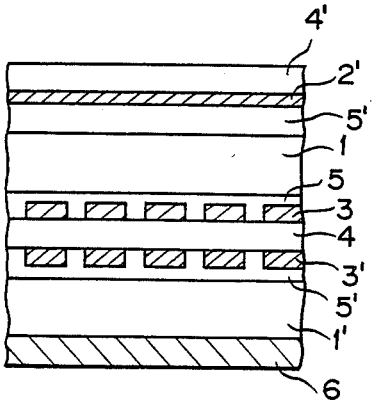
Figure 8:
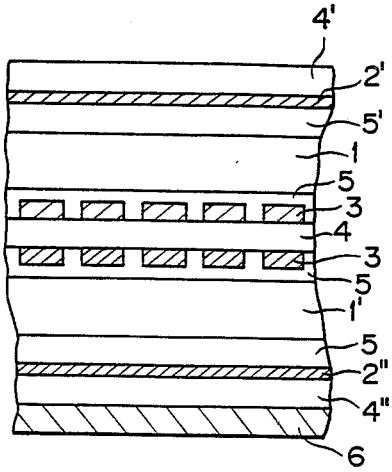

FIG. 4 through FIG. 8 are schematic illustrations showing examples of λ/4 driving type polymeric piezoelectric ultrasonic probes. The probes shown in FIG. 4 and FIG. 5 have further λ/4 acoustic reflective plate 6 provided on the back of the polymeric thin film 4 in addition to those of FIG. 1 and FIG. 2. FIG. 6 through FIG. 8 are schematic illustrations showing examples of polymeric piezoelectric ultrasonic probes of the laminated type and λ/4 driving type in which the polarized directional axes of the polymeric piezoelectric member 1 are arranged as opposed to each other. FIG. 6 shows a probe comprising a polymeric thin film 4 having electrodes for driving 3, 3' of the same shape formed on both surfaces and provided through adhesive layers 5 and 5' between the polymeric piezoelectric member 1 having the common electrode 2 formed thereon and the polymeric piezoelectric member 1' which is opposite to the aforesaid polymeric piezoelectric member 1 in polarized directional axes and is provided on the acoustic non-actuating side with a λ/4 acoustic reflective plate 6. The probe shown in FIG. 7 has a common electrode 2' formed on a polymeric thin film 4' provided through an adhesive layer 5' on the acoustic actuating side of the polymeric piezoelectric member 1 in place of the common electrode 2 formed directly on the piezoelectric member 1 of the probe shown in FIG. 6. Further, the probe in FIG. 8 has a polymeric thin film 4'' having a common electrode 2'' formed thereon which is provided through the adhesive layer 5 on the acoustic non-actuating side of the polymeric piezoelectric member 1' in addition to the probe shown in FIG. 7.

In any of the probes as described above, driving electrodes formed on a polymeric thin film are used and this is the greatest specific feature of the present invention. The common electrode provided on the polymeric piezoelectric member or the polymeric thin film may be connected to a λ/4 acoustic reflective plate made of an electroconductive substrate, if necessary. Further, a λ/4 reflective plate functioning also as the common electrode may be used as in FIG. 6 and FIG. 7. Otherwise, a non-electroconductive acoustic reflective plate comprising ceramics, glass, etc. may also be used, and a common electrode may be provided on such a non-electroconductive acoustic reflective plate.

In the polymeric piezoelectric ultrasonic probe of the present invention, lead wires may preferably be connected according to the method as described below.

Figure 10:
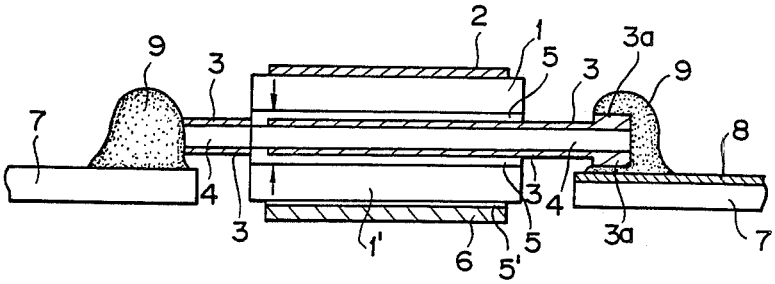
FIGS. 10 through 13 are schematic sectional views of the polymeric piezoelectric ultrasonic probe and the portions of electrodes for driving for illustration of the summary of the present invention.

That is, in connecting lead wires to a polymeric piezoelectric ultrasonic probe using electrodes for driving formed previously on a polymeric thin film as the electrodes for driving which are disposed opposed to a common electrode through an intermediary polymeric piezoelectric member, the lead wires are connected to the electroconductive portions comprising a thick film portion etc. formed at the end portions of the electrodes for driving. FIG. 10 is a schematic sectional view of an example according to the lead wire connecting method for the polymeric piezoelectric ultrasonic probe according to the present invention. In FIG. 10, polymeric piezoelectric members 1 and 1' are provided with opposed polarized axial directions as shown by arrows (↑ or ↓) in the Fig., and a polymeric thin film 4 having previously formed driving electrodes 3 of a specific shape are interposed between the polymeric piezoelectric members 1 and 1'. On the back of the polymeric piezoelectric member 1', there is provided a back reflective plate 6 (λ/4 plate). These polymeric piezoelectric members 1 and 1', polymeric thin film 4 formed with driving electrode 3 thereon and λ/4 plate 6 are acoustically integrated with adhesive layers 5, respectively, thereby constituting a polymeric piezoelectric ultrasonic probe. And, on the electrodes for driving 3 provided on both surfaces of the polymeric thin film 4, thick film portions 3a as electroconductive portions are formed at the end portions of the electrodes 3, and are connected to the lead wire portions 8 provided on a polymeric film 7 such as polyimide film, etc. by solder 9. In this case, since the end portions of the electrodes for driving 3 for connecting the lead wires are made thick, there is no fear of damaging or breaking of a part of the electrodes for driving during the connection of the lead wires 8 with solder, etc. Also, in soldering work where the portions of the electrodes 3 and the lead wires 8 to be soldered are subjected temporarily to high temperature heating, deformation of the electrodes for driving 3 can be inhibited by utilizing a heat-resistant polymeric film such as polyimide film, etc. for the polymeric thin film 4 and the polymeric film 7. Further, by elongating the electrodes for driving 3 of the polymeric thin film 4, thermal conduction to the polymeric piezoelectric members 1 and 1' accompanied the soldering work can be suppressed, whereby depolarization of the polymeric piezoelectric members 1 and 1' can be avoided to prevent lowering its piezoelectric characteristics.

Figure 11:
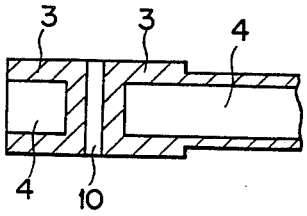
Figure 12:
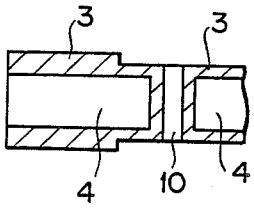
Figure 13:
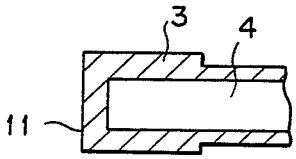

In FIG. 10, electrodes for driving 3 are provided on both surfaces of the polymeric thin film 4, and the electrodes for driving 3 on both surfaces can apply driving signals through the lead wires 8 on the polymeric piezoelectric members 1 and 1' at the same time. In this example, since the electrodes for driving 3 and lead wires 8 are connected by solder, the electrodes for driving on both surfaces are connected at the same time. For further improvement of reliability, the following method can be used. That is, as shown in FIG. 11 through FIG. 13, at a desired place at the end portion of the electrode for driving 3 (FIG. 11) or at a place having no effect on the acoustic actuation of the probe (FIG. 12), the polymeric thin film 4 is made to have a thru-hole 10, and both surfaces are made conductive by provision of an electroconductive portion during formation of the electrodes for driving. Alternately one end of the electrode for driving 3 is made into a turned structure 11 (FIG. 13), whereby reliability can be further improved. Examples of a probe using such a thru-hole are shown in FIG. 14 and FIG. 15.

Figure 14:
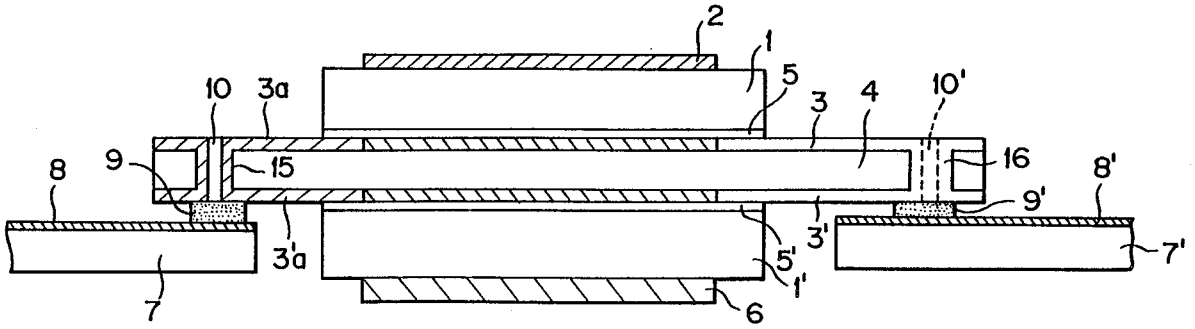
FIG. 14 is a sectional view showing one example of the structure of the polymeric piezoelectric ultrasonic probe of the present invention.
Figure 15:
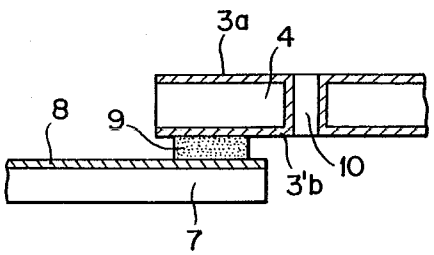

FIG. 14 shows a longitudinal sectional view of a probe with a structure having thru-holes 10, 10' formed as the means for connecting electrically the electrodes for driving on both surfaces to each other on a polymeric thin film having electrodes for driving shaped in rectangular strips formed on both surfaces. In this Figure, electroconductive substance layers 15 and 16 are formed on the inner walls of the thru-holes 10 and 10', and it is particularly advantageous in carrying out the process to constitute these layers of the same material as the electrodes for driving 3 and 3' as hereinafter described. The diameter of the thru-hole is not particularly limited, but it is generally preferred to be set the diameter of the thru-hole at about ½ of the width of the electrode for driving.

By such thru-holes 10 and 10', the lead wire connecting regions 3 and 3' are connected electrically to 3a and 3a', respectively, and therefore it becomes possible to pass current to the electrodes for driving on both surfaces at the same time only by connecting lead wires to one of these, with the result that signals for driving can be applied at the same time on the polymeric piezoelectric members 1 and 1'.

The lead wire to be connected to such electrodes for driving is not particularly limited in kinds, and one may use, for example, lead wires of the same shape as the electrodes for driving as described above, namely the electroconductive region in rectangular strips (lead portion) 8 and 8' formed on the polyimide films 7 and 7', respectively, as shown in FIG. 14, and connect such lead wire through an intermediary anisotropic electroconductive adhesive connectors 9 and 9' which are buried electroconductive fibers, etc. in a rubber sheet.

The above thru-holes 10, 10' may be formed at positions which are not particularly limited, provided that they are in the region apart from the acoustic actuating region of the electrodes for driving (the portion sandwitched in the longitudinal direction between the common electrodes 2 and 6 which are electrically conductive with each other in FIG. 14). And, the anisotropic electroconductive adhesive connector may be positioned at any desired position relative to the thru-holes, and an example is shown in FIG. 15.

Figure 16:
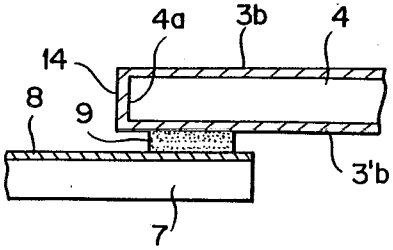
FIG. 15 and FIG. 16 are partial sectional views showing the structures of the lead wire connecting regions.

Further, as the means for connecting electrically the electrodes for driving on both surfaces to each other, other than the thru-holes as mentioned above, a layer 14 consisting of the electroconductive material consituting the electrodes 3b, 3b' may be formed around to the end surface 4a of the polymeric thin film 4 as shown in FIG. 16.

In the present invention, further the lead take-out portion and the common electrode which are formed on the polymeric thin film should be electrically connected to each other through an electroconductive adhesive layer formed intermittently in the longitudinal direction of the lead take-out portion.

Referring to FIG. 17 through FIG. 22, the structure of the lead wire connecting portion of the above polymeric piezoelectric ultrasonic probe of the present invention is described in detail.

Figure 17:
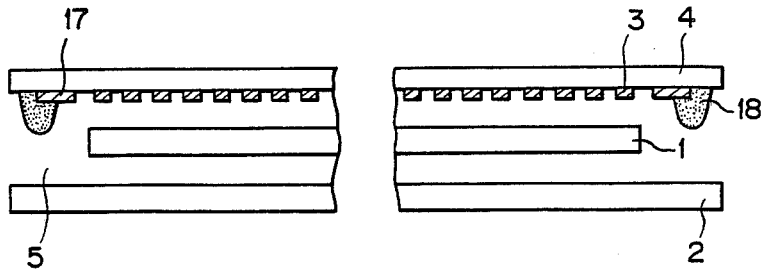
FIG. 17 and FIG. 20 are longitudinal sectional views showing the arrangements of the respective layers of the polymeric piezoelectric ultrasonic probe of the present invention.
Figure 18:
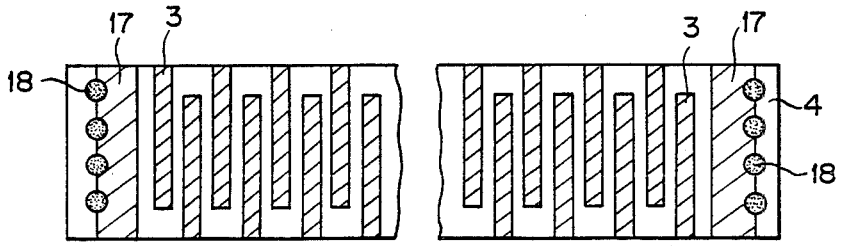
FIG. 18 and FIG. 21 are illustrations showing the state in which the electroconductive layers are formed.
Figure 19:
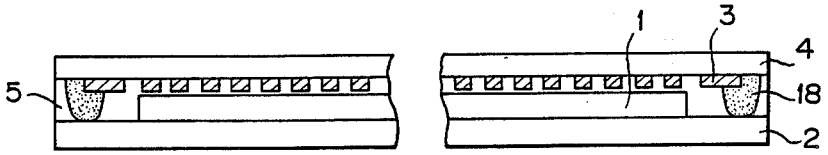
FIG. 19 and FIG. 22 are longitudinal sectional views showing the structures after the respective layers are adhered.

FIG. 17 is a longitudinal sectional view showing the arrangement of the respective constituent layers of a polymeric piezoelectric ultrasonic probe having one layer of a polymeric piezoelectric member, FIG. 18 is an illustration showing the shape of the driving electrodes and the common electrode lead take-out portion of the ultrasonic probe in FIG. 17, and FIG. 19 is a longitudinal sectional view of the structure after the respective constituent layers are adhered.

As seen also from FIG. 18, on the polymeric thin film 4 is formed a common electrode take-out portion 17 in addition to the electrodes for driving shaped in rectangular strips. The common electrode lead take-out portion 17 should advantageously be formed of the same material as that for the electrodes for driving 3 as described above also in carrying out the process. Electroconductive adhesive layers 18 are formed intermittently along, for example, the longitudinal brim portion of the common electrode lead take-out portion 17. As the electroconductive adhesive to be employed, there may be included, for example, Sicolon B (trade name, produced by Atsugi Chuken) or Dortite D-753 (trade name, produced by Fujikura Kasei). In the present invention, it is preferred to form the electroconductive adhesive layer 18 intermittently along the longitudinal direction of the common electrode lead take-out portion 17. This is done for the purpose of permitting the superfluous adhesive of the adhesive layer 5 to escape in the right and left directions in the Figure. Thus, if the electroconductive layer 18 is formed continuously, escape of the adhesive layer 5 is inhibited, whereby inconveniences such of generation as thickness irregularity of the adhesive layer 5 may be caused. More specifically, the electroconductive adhesive layer 18 should be formed preferably in spots as shown in the Figure. The spot size, the spot number and the interval between the spots are not particularly limited, but they can be determined as desired.

Such an ultrasonic probe of the present invention can be prepared as follows. That is, a polymeric piezoelectric member 1, a common electrode 2 and electrodes for driving 3 and a polymeric thin film 4 having a common electrode lead take-out portion portion 17 and electroconductive adhesive layers 18 formed thereon are arranged as shown in FIG. 17, and the respective layers are adhered with adhesive layers 5 interposed between the respective layers under compression in the vertical direction. In this step, as shown in FIG. 19, the electroconductive adhesive layers (spots) 18 are adhered to the confronting common electrode 2, whereby the common electrode take-out portion is connected electrically to the common electrode 2 through the spots 18. Also, in this step, since the superfluous adhesive can escape in the right and left directions in the drawing through the gaps between the respective spots 18, there is the advantage that the adhesive layers can be prevente,d from generation of thickness irregularities.

Then, by connecting the electrodes for driving 3 and the lead take-out portion 17 to, for example, a flexible print substrate (not shown) having lead portions of the same shape as these, it becomes possible to perform lead take-out of both the electrodes for driving 3 and the common electrode 2 at one plate.

Figure 20:
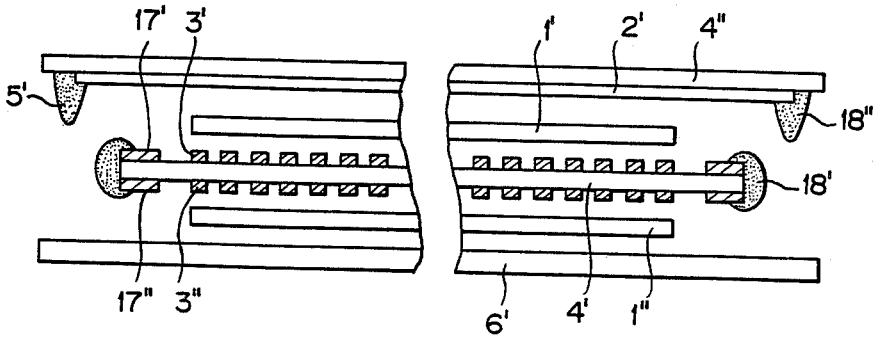

Further, referring to FIG. 19 and FIG. 20, the case of the so-called laminated structure, in which the polymeric piezoelectric ultrasonic probe has a plurality of polymeric piezoelectric members, is described.

Figure 21:
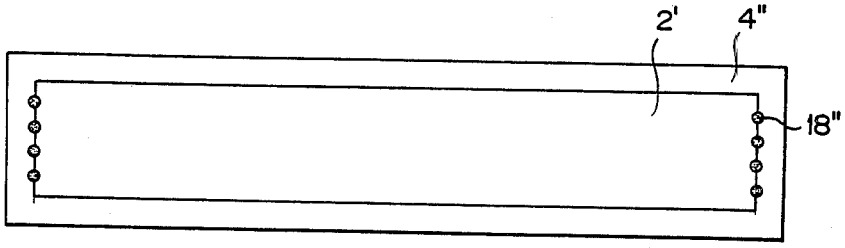
Figure 22:
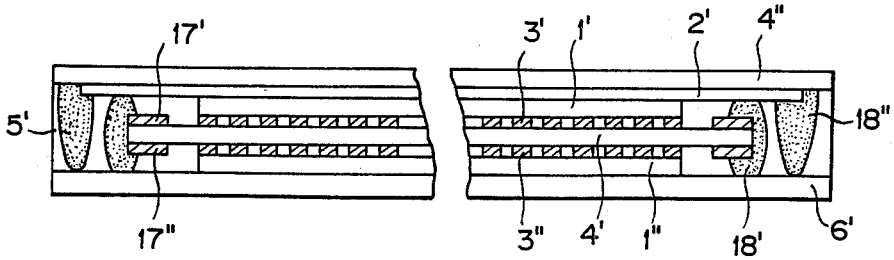

FIG. 20 is a longitudinal sectional view of a polymeric piezoelectric ultrasonic probe having two layers of polymeric piezoelectric members, FIG. 21 is an illustration of electroconductive adhesive formed on the common electrode of the ultrasonic probe in FIG. 20, and, FIG. 22 is a longitudinal sectional view showing the assembled and adhered state.

In FIG. 20, polymeric piezoelectric members 1' and 1'' are arranged so that their polarized axes may be opposed to each other, and a polymeric thin film 4' having electrodes for driving 3' and 3'' shaped in rectangular strips formed on both surfaces thereof is interposed between the both members. On both surfaces of the polymeric thin film 4' are formed the same common electrode lead take-out portions 17' and 17'' as described above, simultaneously with formation of spot-like electroconductive layers 18' connecting the upper and lower lead take-out portions 17' and 17''. Also, on the side opposed to the electrodes for driving 3' of the polymeric piezoelectric member 1', a common electrode 2' formed on a polymeric piezoelectric member 4'' is arranged, while on the side opposed to the electrodes for driving 3'' of the polymeric piezoelectric member 1'', a λ/4 plate 6' functioning also as the common electrode is provided. The two common electrodes 2' and 6' are both electrically connected and grounded. Accordingly, on either one of the common elecrodes, for example, the common electrodes 2 and 2', electroconductive layers 18'' shaped in spots as shown in FIG. 21 are formed in the same manner as described above. And, the respective constituent layers may be adhered to one another with adhesive layers 5'. As shown in FIG. 22, the common electrodes 2' and 6' are thereby electrically connected to each other through the electroconductive adhesive layers 18'' simultaneously with being electrically connected to the common electrode lead take-out portions 17' and 17'', respectively, through the electroconductive adhesive layers 18'. Accordingly, similarly as described above, all the lead take-out of the electrodes for driving 3', 3'', and the common electrodes 2' and 6' can be performed at one place.

Further, the polymeric piezoelectric ultrasonic probe of the present invention may preferably be a polymeric piezoelectric ultrasonic probe having a plurality of polymeric piezoelectric members through a polymeric thin film having previously formed electrodes for driving thereon laminated with their polarized axis directions opposed to each other, and a first common electrode provided on the acoustic actuating side of the piezoelectric member and a second common electrode or common electrode functioning also as the λ/4 acoustic support provided on the acoustic non-actuating side thereof, wherein the above first common electrode and the second common electrode or the common electrode functioning also as the λ/4 acoustic support have the same shape, and further are placed at positions not protruded from each other as viewed from the direction in which the above common electrodes and the electrodes for driving are laminated.

Figure 23:
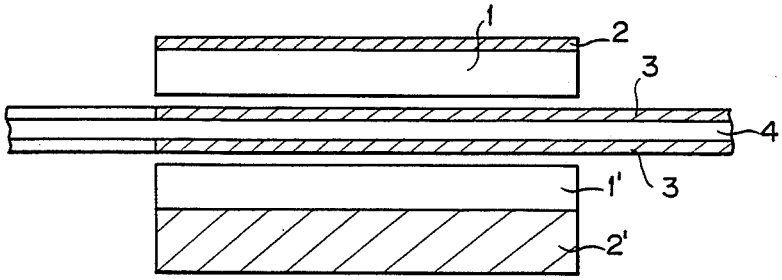
FIG. 23 is a schematic sectional view of the polymeric piezoelectric ultrasonic probe according to the present invention.
Figure 24:
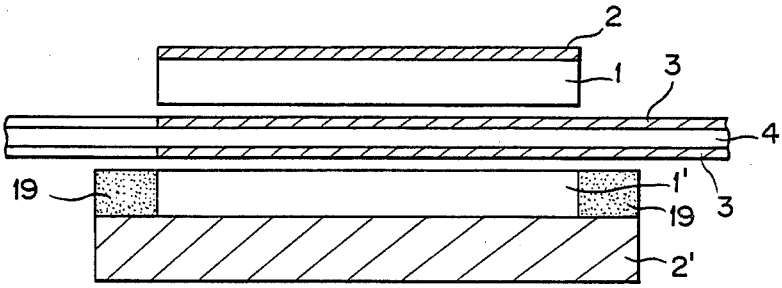
FIG. 24 and FIG. 25 are sectional views of ultrasonic probes in which the common electrode and electrodes for driving are deviated in position or different in shape.
Figure 25:
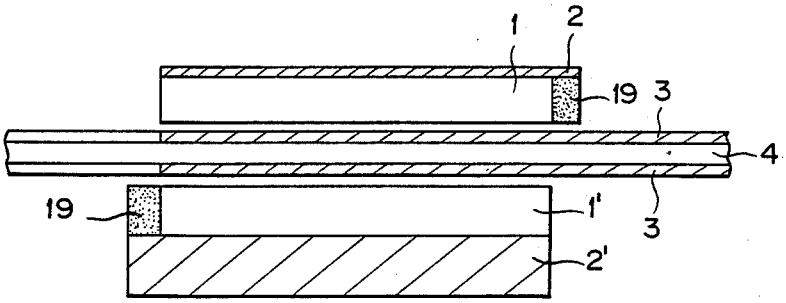

An example of such an embodiment is shown as a schematic sectional view in the laminated direction in FIG. 23. In the Figure, there is shown an example in which a first electrode on the acoustic actuating side and a common electrode functioning also as the λ/4 acoustic support on the acoustic non-actuating side are used. The electric impedance of the polymeric piezoelectric member driven in the Figure is determined by the polymeric piezoelectric member 1, the first common electrode 2 and the portion sandwitched between the polymeric piezoelectric member 1' and the common electrode functioning also as the λ/4 acoustic support 2'. For example, as shown similarly in FIG. 24, when the common electrode functioning also as the λ/4 acoustic support 2' is different in shape from the portion of the other common electrode 2, or as shown in FIG. 25, the polymeric piezoelectric members 1 and 1' are deviated in position even if the common electrode 2 and the common electrode functioning also as the λ/4 acoustic reflective plate 2' may be of the same shape, the electric impedance of the polymeric piezoelectric member which is normally driven will differ as compared with the polymeric piezoelectric members 1 and 1' sandwitched between the common electrode 2 and the common electrode functioning also as the λ/4 acoustic reflective plate 2'. Besides, the deviated portion 19 between the polymeric piezoelectric members 1 and 1' and the common electrode or the common electrode functioning also as the λ/4 acoustic reflective plate 2 and 2' will bring about changes in frequency in ultrasonic wave or input or output signal levels such as a difference of the vibration mode of the polymeric piezoelectric member 1 and 1' from the normal vibration mode, thereby effecting frequency change in the ultrasonic wave generated.

For this purpose, it is required as shown in FIG. 23 that the common electrode 2 and the common electrode functioning also as the λ/4 acoustic support 2' sandwitching the polymeric piezoelectric members 1 and 1' therebetween should be made to have the same shape, and also that no deviation in position should occur between the common electrode provided on the polymeric piezoelectric member 1 and the common electrode functioning also as the λ/4 acoustic reflective plate 2' provided on the polymeric piezoelectric member 1'. For prevention in deviation in position between the common electrode 2 and the common electrode functioning also as the acoustic reflective plate 2', there may be employed, for example, the method in which the polymeric piezoelectric members 1 and 1' are tentatively fixed with an adhesive at the portions having no effect on the generation of ultrasonic wave, followed by adhesion.

In the present invention, further as a structure which is free from generation of contact between the λ/4 plate and electrodes for driving or breaking of the electrodes for driving even when deviation in position may occur between the λ/4 plate and the polymeric piezoelectric member, there is provided preferably a polymeric piezoelectric ultrasonic probe, wherein the both end portions along the longitudinal direction of the electrodes for driving of the polymeric piezoelectric member are protruded out of the both end portions of the common electrode.

Figure 26:
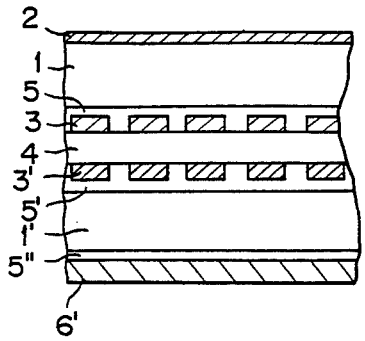
FIG. 26 through FIG. 29 are sectional views showing one example of the structure of the polymeric piezoelectric ultrasonic probe of the present invention.

Thus, in FIG. 26, between a pair of polymeric piezoelectric member 1 and 1' arranged so that the polarized axes may be opposed to each other, there is interposed a polymeric thin film 4 having electrodes for driving 3 and 3' shaped in rectangular strips. As is apparent also from the Figure, the electrodes for driving 3 and 3' are formed on both surfaces of the polymeric thin film 4, respectively, and registration between the upper and lower electrodes 3 and 3' is effected very accurately. The polymeric thin film 4 is adhered to the upper and lower polymeric piezoelectric members 1 and 1' through the adhesive layers 5 and 5', respectively. And, on the upper surface of the polymeric piezoelectric member 1, a common electrode 2 made of, for example, Ag is formed, while on the non-acoustic side at the lower surface of the polymeric piezoelectric member 1', there is formed a λ/4 plate 6' functioning also as the common electrode, respectively.

In an ultrasonic probe with such a structure, the common electrode 2 and the λ/4 plate 6 are ordinarily formed on substantially the whole surface of the polymeric piezoelectric members 1 and 1', and the regions corresponding to the longitudinal directions of these common electrodes 2 and 6' become the acoustic actuating regions 3*d* and 3'*d* of the electrodes for driving 3 and 3'. Meanwhile, in the steps for manufacturing such a probe, deviation in position may sometimes occur along the longitudinal directions of the electrodes for driving 3 and 3' between, for example, the λ/4 plate 6' and the polymeric piezoelectric member 1'. Since the λ/4 plate is generally constituted of a metal plate such as of copper, brass, etc., when there occurs a deviation in position between the λ/4 plate 6' and the polymeric piezoelectric member 1' as mentioned above, inconveniences may be sometimes caused such as electrical connection through contact between the λ/4 plate 6' and the electrodes for driving 3', breaking of the electrodes for driving 3' through mechanical contact with the λ/4 plate 6', etc. As the result, problems may sometimes ensue such that injection of power for driving is rendered impossible or that the excitation frequency for the polymeric piezoelectric member changes.

Figure 27:
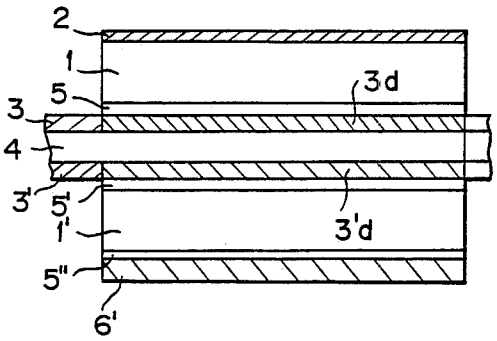
Figure 28:
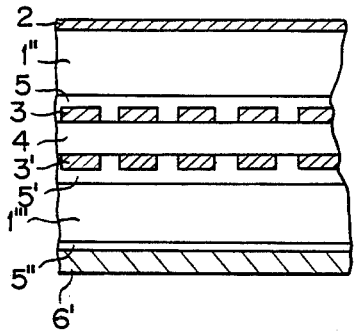
Figure 29:
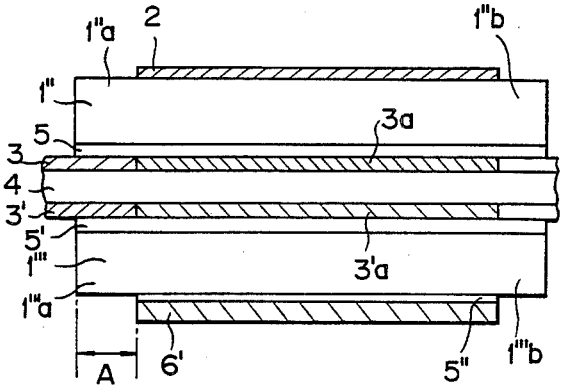

A preferred construction for solving such a problem is described in more detail by referring to FIG. 28 and FIG. 29. FIG. 28 and FIG. 29 show, similarly as FIG. 26 and FIG. 27 as described above, a sectional view cut along the direction perpendicular to the longitudinal direction of the electrodes shaped in rectangular strips and a sectional view cut along the direction in parallel thereto, respectively. In these Figures, the members affixed with the same symbols represent the same members, respectively, except for the polymeric piezoelectric members 1'' and 1'''.

The specific feature of these Figures, as described above, resides in that the polymeric piezoelectric members 1' and 1''' exist extended in the longitudinal direction (the horizontal direction in FIG. 29) of the electrodes for driving 3 and 3' relative to the common electrode 2, the λ/4 plate 6' functioning also as the common electrode and the acoustic actuating regions 3*a*, 3'*a* of the electrodes for driving 3 and 3' shaped in rectangular strips. That is, in FIG. 29, the end portions 1''*a*, 1''*b*, 1'''*a* and 1'''*b* are portions existing extended from the above driving region. In FIG. 26, electrodes shaped in rectangular strips are formed in a comb-like shape and the lead wires are connected to both surfaces, and hence the polymeric piezoelectric members 1'' and 1''' are shown as extending in both the left and right directions in the Figure, but the directions in which the piezoelectric members are extended are set depending on the shape of the electrodes for driving, as a matter of course.

The length A of the extended portions of the polymeric piezoelectric members 1'' and 1''' is not particularly limited, but can be determined adequately depending on the shape and size of the ultrasonic probe as a whole and the layer thicknesses of respective layers, with no unnecessary enlargement leading only to increased dimensions of probe being required, and may preferably be about 3 to 10 mm.

The polymeric piezoelectric ultrasonic probe of the present invention may also preferably be a polymeric piezoelectric ultrasonic probe where the size of electrodes for driving in the longitudinal direction is greater than the size of a first common electrode and a second common electrode or the common electrode functioning also as the λ/4 acoustic support in the direction parallel to the longitudinal direction of the electrodes for driving.

With such a construction, it becomes possible to provide a probe in which the change in electric impedance of the polymeric piezoelectric ultrasonic probe and the frequency change of the ultrasonic wave generated accompanied with a non-uniform in thickness vibration mode of the polymeric piezoelectric member are prevented.

Figure 30:
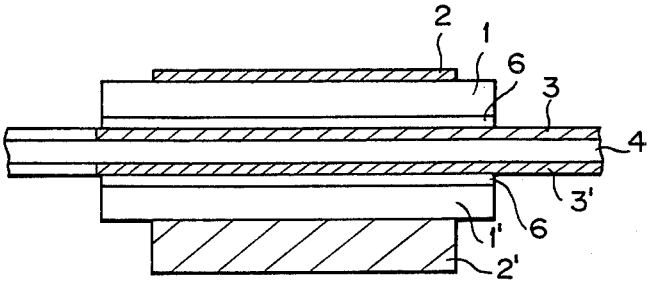
FIG. 30 and FIG. 31 are sectional views representing the polymeric piezoelectric ultrasonic probe according to the present invention.
Figure 31:
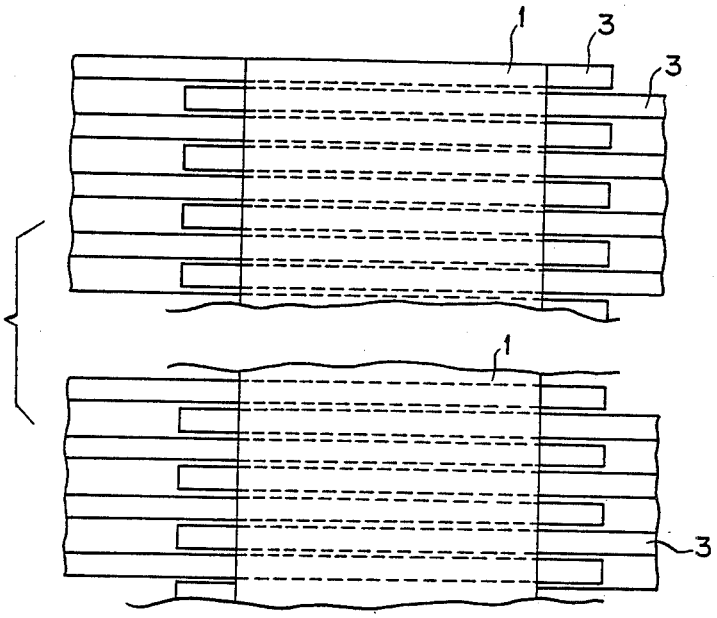

An example is shown in a schematic sectional view as shown in FIG. 30. In the Figure, the electrode for driving 3 is made greater in its longitudinal direction (the horizontal direction in the Figure) than the common electrode 2 and the common electrode functioning also as the acoustic support 2', and the above electrodes for driving are provided as protruded when viewed from the laminated direction of these electrodes. Between the electrodes for driving and the commcn electrode and between the electrodes for driving and the common electrode functioning also as the λ/4 acoustic supporting member, polymeric piezoelectric members 1 and 1' are provided.

In the present invention, in the ultrasonic probe using a polymeric piezoelectric member as the vibrator, it is preferable to use a toroidal type inductor as the inductor to be used for impedance matching between the power for driving the aforesaid ultrasonic probe and the aforesaid vibrator.

In the prior art, the inductor was generally composed of a drum type comprising a core made of a magnetic material such as a ferrite, carboneel, etc. around which a coating copper wire etc. was wound. This is because the drum type had a small scale and a structure around which a copper wire, etc. could be easily wound. In the drum type inductor, the magnetic field is also generated outside the inductor on account of its structure. Accordingly, if there are inductors close to one another mutual induction will be caused. Particularly, since an array type ultrasonic probe is operated with hands by a physician, compactness and easiness in handling are important conditions. By use of drum type inductor, the pulse applied on one channel results, through mutual induction in driving of other channels. As a consequence, a problem arises in that a virtual image or an image with low resolution is caused to form. For overcoming this problem, there is provided a pot-type inductor shielded with a pot-type ferrite, etc. so that the magnetic filed may not leak out, but such a pot-type inductor, due to its structure can only be miniaturized with difficulty, and therefore it has been impossible to constitute a compact ultrasonic probe which can be handled easily.

However, according to the construction as described above, the problems of virtual image, low image quality, etc. through mutual induction in use of a drum-type inductor or the problem of great scale in use of a pot-type inductor as described above can be overcome, whereby it becomes possible to obtain a compact polymeric piezoelectric ultrasonic probe with high sensitivity and high resolution. The structure of a toroidal type inductor is composed of a core of a doughnut shaped magnetic material such as ferrite, carboneel, etc. around which a coating copper wire is wound. In this structure, the magnetic field is generated within the core and therefore does not leak out of the inductor.

On the other hand, as a means for lowering electrical impedance, when the electrical equivalent circuit in the vicinity of the central frequency of the vibrator is represented by the series circuit of resistance R and capacity C, there has heretofore been proposed the method in which an inductor having reactance $X_L$ equal in absolute value to the capacity reactance $X_c$ of the equivalent circuit is connected in series to the vibrator. When such an inductor is used, since resonance between the capacity C ($=1/\omega Xc$: ω is angular frequency) and the inductance L ($=X_L/\omega$) occurs in the vicinity of the central frequency, impedance in the vicinity of the central frequence is lowered to give the maximum sensitivity as the ultrasonic probe. Whereas, when the reflected wave from the subject to be tested and its frequency spectrum obtained when practicing the pulse echo method by using the ultrasonic probe are observed, it can be seen that the vibration of the reflected wave continues long and also that the specific band region width is reduced. Long continuation of vibration of the reflected wave, namely narrow specific band region width means that distance resolving power is lowered. Accordingly, there has been brought about the result of deterioration of the image quality of the ultrasonic wave obtained by processing of the reflected wave.

However, this problem has also been solved by the construction that, when the induction reactance equal in absolute value to the capacity reactance in a series circuit of resistance and capacity representing an electrical equivalent circuit in the vicinity of the central frequency of the vibrator made of a polymeric piezoelectric member is defined as $X_L$, it can be overcome by selecting the reactance $X_0$ of the inductor connected in series to the vibrator within the range of $0.6\ X_L < X_0 < 0.8\ X_L$.

With such a construction, the value of the inductor for impedance matching between the vibrator made of a polymeric piezoelectric member and a driving circuit system or a receiving circuit system can be optimized, thereby providing a polymeric piezoelectric ultrasonic probe which is high in sensitivity and also broad in specific band region width.

Figure 32:
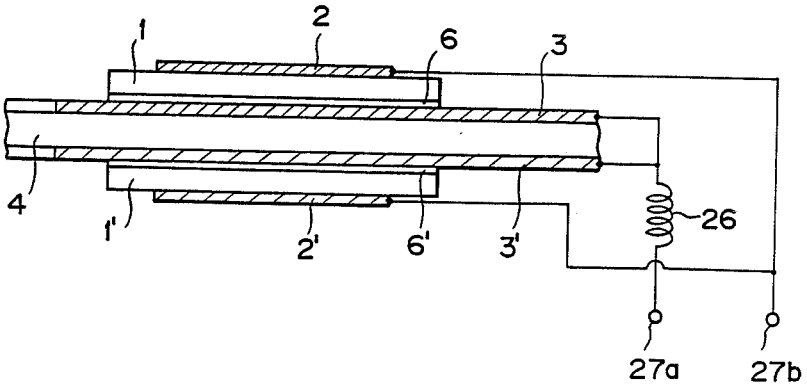
FIG. 32 is a sectional view of the polymeric piezoelectric ultrasonic probe according to an example of the present invention.

FIG. 32 is a sectional view of such a polymeric piezoelectric ultrasonic probe, and is similar as that shown in FIG. 30. It has a basic structure in which there is formed a vibrator having a polymeric piezoelectric members 1 and 1' which electrodes 3 and 3' are further connected through the inductor 26 to the electrode terminals 27*a* and 27*b*.

The electrode terminals 27*a* and 27*b* are terminals to be connected to the driving circuit and the receiving circuit which are not shown.

Figure 33:
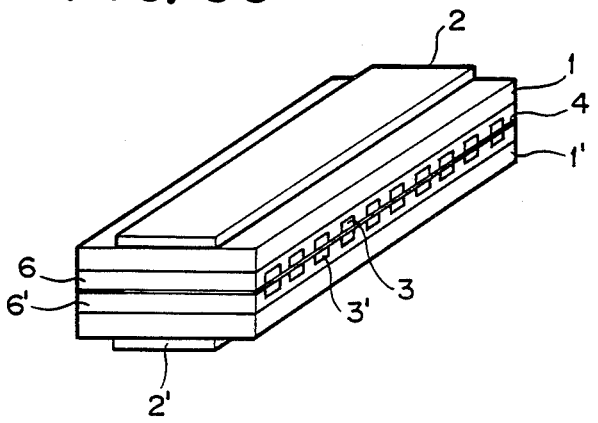
FIG. 33 is a perspective view showing the construction constitution of an array type ultrasonic probe.

When an array type ultrasonic probe for electron scanning to be used in an ultrasonic diagnostic apparatus, etc. is to be constructed, a large number of the vibrators, for example, as shown in FIG. 32 are arranged linearly as shown in FIG. 33. Here, since the vibrator is formed by using a polymeric piezoelectric members 1 and 1' and electrodes 3 and 3' are formed on a thin film 4 separately and the common electrodes 2 and 2', it is not necessarily required that the piezoelectric member should be cut and separated for each element.

Figure 34:
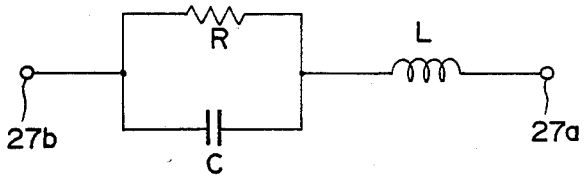
FIG. 34 and FIG. 35 are electrical equivalent circuits of a probe consisting of a polymeric piezoelectric member.
Figure 35:
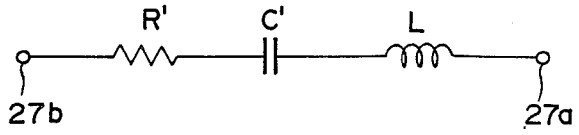

The electrical equivalent circuit of the ultrasonic probe in FIG. 32 is shown in FIG. 34 and FIG. 35. The vibrator is generally represented by the parallel circuit of the capacity C and the resistance R, and the inductance of the inductor by L. These parallel circuit CR and inductance L are connected in series between the electrode terminals 27*a* and 27*b*. The parallel circuit of CR can also be represented as transformed to a series circuit of the resistance component and the capacity component as shown in FIG. 35. In this case, the resistance component R' and the capacity component C' are as follows, respectively:

$$R' = R/\{1+(\omega CR)^2\}$$

$$C' = 1+(\omega CR)^2/\omega^2 CR^2$$

where $\omega$ is an angular frequency. Here, the inductance value L of the inductor for cancelling the capacity component C' is represented as follows, with the central frequency of ultrasonic vibration being $\omega_0$:

$$L = 1/\omega_0^2 C'(\omega=\omega_0).$$

Relative to this inductance value L, the inductance value $L_0$ of the inductor in the present invention is selected as $0.6\ L < L_0 < 0.8\ L$. In other words, when the induction reactance equal in absolute value to the capacity reactance Xc in FIG. 35 is defined as $X_L$, an inductor having a reactance $X_0$ within the range of $0.6\ X_L < X_0 < 0.8\ X_L$ is connected. In the following, the reason why the value of L is so selected is described in detail.

As the amounts for representing performance of an ultrasonic probe, there are sensitivity and specific band region widths. The ultrasonic wave radiated into a subject to be tested such as a living body or metal will be reflected if there is a material different in acoustic impedance in the propagating route (e.g. tumor, defect, etc.), and the reflected wave is received by the ultrasonic probe. Sensitivity is the wave height value of the reflected wave, and an ultrasonic image with better S/N can be obtained at higher sensitivity, as a matter of course.

On the other hand, the specific band region width is determined from the frequency component of the reflected wave. More specifically, the value ($\Delta f/f_0$) obtained by dividing the frequency width ($\Delta f$) at $-10$ dB or $-20$ dB from the peak value of the frequency spectrum of the reflected wave by the central frequency ($f_0$) is the specific band region width. Since Fourier transformation of the reflected wave is the frequency spectrum, the specific band region width becomes smaller as the ringing of the reflected wave is more, while it becomes larger as the ringing is less.

The largeness and smallness of the specific band region width is related to the distance resolving power. Now, suppose reflective entities A and B are supposed to exist nearby in the propagation direction of the ultrasonic wave. When the reflected waves generated at A and B return to the ultrasonic probe and are detected as signals, if the vibration of the reflected wave generated at the entity A nearer to the probe continues for a long time, the reflected wave against the entity A will overlap the reflected wave generated against the entity B. As a result, the entities A and B cannot be distinguished from each other but will be recognized as one reflective entity in the ultrasonic probe. Accordingly, there results a lowering in distance resolving power which deteriorates the image quality of the ultrasonic image. Such lowering in distance resolving power is caused by too much ringing of the reflected wave, and therefore less ringing, namely larger specific band region width is required for improvement of distance resolving power.

Specifically, 2 mm or less is generally demanded as the distance resolving power and, in order to realize such a distance resolving power at an ultrasonic frequency (3.5–5 MHz) used for general purpose in ultrasonic diagnostic apparatus, etc., 50% or more of specific band region width is required.

Figure 36:
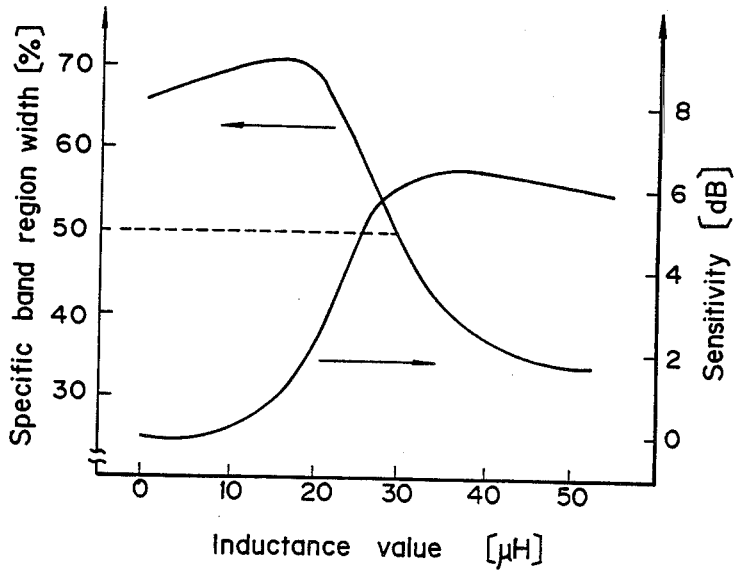
FIG. 36 is a chart showing the changes in sensitivity and specific band region width measured relative to the change in inductance value of the inductor connected in series to a probe.

Here, the inductance value of the inductor connected in series to the vibrator in FIG. 32 has great effect on the sensitivity and the specific band region width as described above. FIG. 36 shows the changes in sensitivity and specific band region width when the inductance value is varied. From this Figure, it can be seen that the specific band region width at the inductance value which gives the highest sensitivity is 40%, which does not satisfy 50% as required, thus being insufficient as performance of the ultrasonic probe in practical applications. The inductance value (L) which gives the highest sensitivity corresponds to the induction reactance $X_L$ equal in absolute value to the reactance Xc of the capacity component C' when the electrical equivalent circuit of the vibrator is given by the series circuit C' and R' as in FIG. 35.

As can be understood from FIG. 36, for the specific band region width to become 50% or higher, the inductance value may be made 0.8 L or lower. However, sensitivity will be lowered as the inductance value is smaller to make S/N smaller. Also, if the inductance value is made too small, removal of high tone wave which is another effect of connection of an inductor becomes insufficient, whereby many high tone wave components are contained in the reflected wave to bring about lowering in resolving power from this aspect.

As the sensitivity on a practical level of the ultrasonic probe, 4.5 dB or higher as compared with the case when no inductor is connected is required, and the inductance value at such a sensitivity is 0.6 L as is apparent from FIG. 36. Besides, if an inductance value to such an extent is ensured, removal of high tone wave components can sufficiently be done to cause no lowering in resolving power. Here, the sensitivity is in the range of 4.5 dB or higher as mentioned above, which is within −2 dB relative to the maximum sensitivity, and involves no problem in characteristics at all.

For the reasons as described above, by selecting the inductance value $L_0$ of the inductor 26 within the range of $0.6\ L<L_0<0.8\ L$, in other words, the reactance $X_0$ within the range of $0.6\ X_L<X_0<0.8\ X_L$, the specific band region width becomes 1.5-fold of that at the maximum sensitivity, while ensuring sensitivity at a value sufficient in practical application within −2 dB relative to the maximum sensitivity, whereby the required distance resolving power can be satisfied.

When the drum type inductor is employed for unavoidable reasons, for impedance maching between the sending and receiving circuits in a polymeric piezoelectric array ultrasonic probe, it is preferred that the above drum type inductors existing nearby should be arranged so as to cross each other at right angles.

With such a construction, cross-talk accompanied with mutual induction can be reduced.

The electrical equivalent circuit near the resonance point of a polymeric piezoelectric member can be approximated by the parallel circuit of resistance component and capacity component. Here, there is usually used the method in which coils are connected in series so as to lower electrical impedance by removing the capacity component of the polymeric piezoelectric member having high electrical impedance. Of the coils, there are generally the drum type and the troidal type, and the former will not be saturated at some 100 V which is the application voltage on the ultrasonic probe generally employed, but involves the drawback of causing mutual induction when coils exist at near positions, because magnetic flux is also formed outside of the coil on account of its structure. As a result, there is exhibited the state in which not only the driving channel but also other channels nearby are driven, thereby causing cross-talk having an adverse effect on the image. In fact, in an array type ultrasonic probe, due to restriction in size of its channel pitch and probe, the coils are mounted in most cases closely to or in the vicinity of one another. For this reason, cross-talk accompanied with mutual induction has been a problem. On the other hand, the latter toroidal type coil, while causing little or no cross-talk because the magnetic flux is generated within the core, has the problems of insufficiently exhibiting the function of a coil such as there is insufficient application of voltage on the driving channel, because it is more liable to be saturated as compared with a drum type coil. Particularly, since a polymeric piezoelectric member has an electromechanical binding coefficient of 20 to 30% which is smaller as compared with that of a piezoelectric ceramic such as titanium, lead zirconate, etc., the sensitivity is insufficient in a troidal type coil as compared with a drum type coil to give an image with bad S/N ratio. Accordingly, drum type coils have been usually employed, but these coils will readily generate cross-talk accompanied with mutual induction, with the result that there is a great possibility of a virtual image during image evaluation which will cause an erroneous diagnosis.

Figure 37:
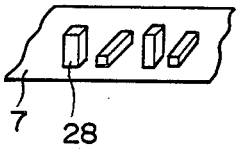
FIG. 37 through FIG. 39 are perspective views of an example of the present invention in which drum type inductors are arranged so as to cross each other at right angles.
Figure 38:
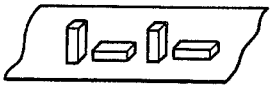
Figure 39:
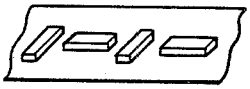
Figure 40:
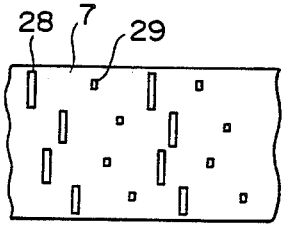
FIG. 40 is a perspective view of another example of the present invention in which drum type inductors are arranged so as to cross each other at right angles for every four elements.

Since the dielectric constant of these polymeric piezoelectric members and composite type piezoelectric members is markedly smaller as compared with that of piezoelectric ceramics, it is essentially required to use coils for electrical matching during manufacturing of ultrasonic probes with a small driving area of one element such as an array type ultrasonic probe, etc. Accordingly, description is now made by referring to an example of a linear array ultrasonic probe which is most suited for general purposes. The drum type coil as herein mentioned refers to a coil consisting of a core made of ferrite, etc. and a coating copper wire wound therearound. These coils are generally mounted on a glass epoxy substrate or a flexible print plate, etc. and connected on the side of vibrators. They are mounted according to the method as shown in FIG. 37 through FIG. 39 so that the central axes of the cores, namely the directions of the magnetic flux within the cores may cross each other at right angles. In the Figures, 7 represents a print substrate and 28 coils. As a result, between adjacent coils, since the magnetic flux crosses the central axis of the core at right angle and therefore there occurs no change in magnetic flux with time, mutual induction is caused only with difficulty, resulting in no cross-talk. Practically, however, due to restriction in size of the channel pitch, the ultrasonic probe and the coil of a linear array ultrasonic probe, the same effect can be obtained by, for example, mounting 4 elements so that the central axes of the cores of the coils 28 and 29 may be in parallel to the print substrate surface 7, as shown in FIG. 40, and then arranging them so that they cross each other at right angles.

Next, description is made about the case when a cable is connected to the polymeric piezoelectric ultrasonic probe of the present invention.

Connection of a cable to the ultrasonic probe of the present invention can be carried out according the method of connecting a coaxial cable consisting of a core wire; a core wire coating layer; an earth wire wound around the core wire coating layer; and a coating layer covered over the earth wire to a vibrator of the ultrasonic probe, wherein the core wire coating layer at the tip end portion of the cable is exposed over a length of 3 cm or less, and the earth wire is taken out at a length of 3 cm or less. According to the above method, by connecting a multi-channel ultrasonic probe to a cable, it is possible to prevent deterioration of the characteristics of the probe and cross-talk between channels caused by the inductance components of the exposed portion of the core wire coating layer and the earth wire take-out portions.

In an ultrasonic probe of an array type structure, image can be obtained by electron scanning and in that case, it is preferred to enhance the resolving power of the image by increasing the number of the channels (one vibrator forms one channel) as much as possible.

In the case of driving a multi-channel ultrasonic probe, it is generally practiced to apply a pulse voltage on each channel, namely each vibrator, through a cable from an external signal sending circuit. The cable used is a coaxial cable having an earth wire wound around a core wire, and its characteristic impedance is generally 50 Ω or 75 Ω. For this reason, the sending and receiving circuits and the ultrasonic probe itself are designed so as to have the same impedance as the above characteristic impedance of the cable to be electrically matched thereto.

On the other hand, as a means for connecting a vibrator to a cable, there are the method of direct connection by soldering and the method of connection through a pin connector. However, some of piezoelectric members, for example, the polymeric piezoelectric members as described above, cannot be soldered or may deteriorate in their characteristics as a piezoelectric element as a result of soldering. Also, in the case of using a pin connector, due to spatial restriction, lowering in workability may frequently be brought about. Accordingly, it is generally practiced to take out leads from the respective vibrators with a print substrate, etc. and connecting the lead portions to the cables.

Figure 41:
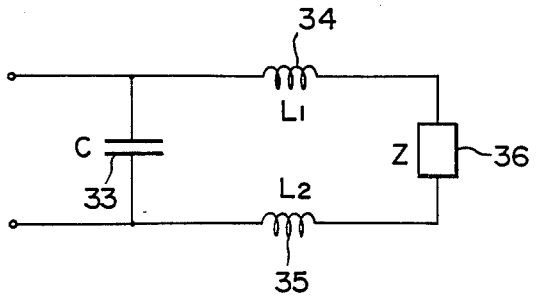
FIG. 41 and FIG. 42 are charts showing equivalent circuits of the cable connecting region of the prior art.

In connecting such a coaxial cable to lead portions of each vibrator, problems are posed in the length of the core wire coating layer exposed and the length of the earth wire taken out. That is, the inductance components at the exposed portion of the core wire coating layer and the take-out portion of the earth wire cannot be disregarded. Now, if the components corresponding to one channel of vibrator are considered, their equivalent circuit may be as shown in FIG. 41. In the Figure, 33 shows the capacity C of the cable, 34 the inductance $L_1$ at the exposed portion of the core wire coating layer of the cable, 35 the inductance $L_2$ of the take-out portion of the earth wire and 36 the impedance Z when the cable is viewed from the vibrator side. For example, when the whole length of the cable is 2.4 m and its capacity is 110 pF/m, and the length of the exposed portion of the core wire coating layer is 20 cm, $L_1=L_2\approx 0.3$ μH, namely values which cannot be disregarded.

Figure 42:
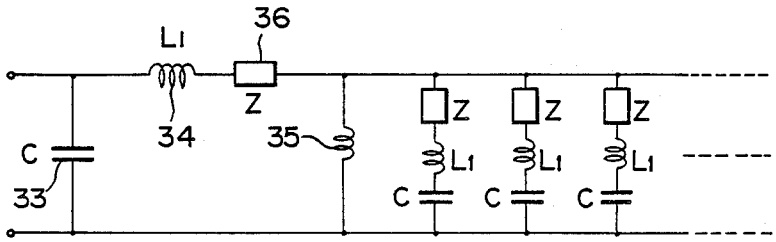
Figure 43:
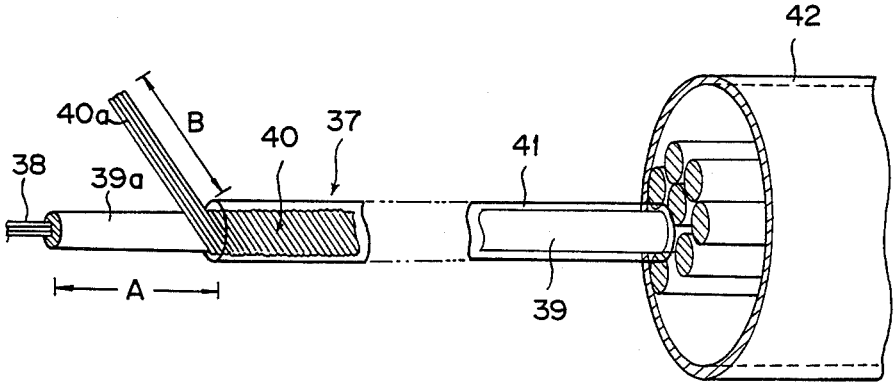
FIG. 43 is an illustration showing the tip end portion of the coaxial cable to be used in the method of the present invention.

Further, in the case of an ultrasonic probe having a plurality of channels as described above, cables in the same number as the channels are required to be connected and therefore the equivalent circuit when the earth wire is made common is as shown in FIG. 42. That is, to the components of one channel as shown in FIG. 43, Z, $L_1$ and C of respective channels are connected in parallel, respectively.

As described above, due to the inductance components determined by the length of the exposed portion of the core wire coating layer and the length of the take-out portion of the earth wire of the cable, there ensues the problem that the pulse voltage cannot be effectively applied on each vibrator. There may also occur the case in which the elements of other channels are driven due to the presence of the inductance component at the take-out portion of the earth wire (cross-talk), whereby there is involved inconvenience of having deleterious effect on image characteristics.

In the above method, the cable to be used is not particularly limited, provided that it is a coaxial cable in which a core wire is shielded with an earth wire. Usually, as shown in FIG. 43, a core wire 38 is coated with a core wire coating layer 39 made of polyethylene, Teflon type material, etc. and an earth wire 40 is wound around the coating layer in, for example, a spiral, followed further by winding of, for example, a polyester film 41 over the earth wire to give a coaxial cable 37 with a structure prevented from slippage of the earth wire.

In such a coaxial cable 37, it is preferable to use, for example, a copper wire with a line diameter of about 0.05 to 0.15 mm applied with tin plating as the core 38 and the earth wire 40, and a bundle of 5 to 10 of such wires for the former and a bundle of 20 to 30 of such wires for the latter. Also, the cable capacity may generally be 60 pF/m or 110 pF/m.

Further, as shown in FIG. 43, it is possible to use a bundle of a plurality of the coaxial cables as described above (e.g. 32 or 64 cables) which is coated with, for example, a synthetic rubber such as neoprene, etc., or a double-shield structure having a bundle of a plurality of the coaxial cables wound around on its outside with a metal shaped in a mesh. The characteristic impedance of these cables may generally be set at 50 Ω or 75 Ω in order to be matched to the power system.

When carrying out connection to an ultrasonic probe with the use of such a coaxial cable 37, the polyester film 41 on the outside of the cable tip portion is peeled off to expose the core wire coating layer 39 and at the same time the earth wire 40 is taken out. When the length of the exposed portion **39*a* of the core wire coating layer 39 is defined as A and that of the take-out portion 40*a* of the earth wire 40** as B, both A and B are required to be 3 cm or less. If A and B exceed 3 cm, the inductance components of the respective portions can no longer be disregarded, whereby there is caused a lowering the characteristics of the ultrasonic probe causing deterioration of image characteristics arising from cross-talk between channels. Preferably, both A and B may be set at 1 cm or less.

Figure 44:
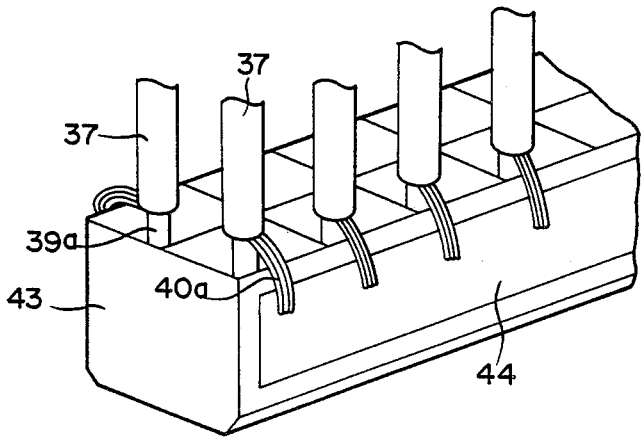
FIG. 44 is a perspective view showing the state in which the coaxial cable in FIG. 43 is connected to a connector socket.

Then, as described above, the cable exposed at its tip portion of the cable is connected to the lead portion of each channel of the ultrasonic probe. The connecting method may be any method, and, for example, it is convenient to use a connector socket 43 as shown in FIG. 44. That is, the exposed portion **39*a* of the core wire coating layer at the tip portion of the cable 37 is inserted into the socket 43, while the take-out portion 40*a* is connected to the copper plate 44 plastered on the side wall of the socket 43 by soldering, respectively, and made at the ground potential. Under such a state, the socket 43** may be connected to the lead portion of each channel formed on, for example, a print substrate.

EXAMPLES

EXAMPLE 1

One or both electrodes of a film consisting of $PVF_2$.TrFE copolymer with a thickness of 75 μm previously applied with polarizing treatment were peeled off by etching to prepare a polymeric piezoelectric member. Further, as the electrodes for driving, silver was vapor deposited to a thickness of about 1 μm on a polymeric thin film of a polyimide film (Kapton 50H, trade name, produced by Toray), followed by etching to form electrodes with an inherent pattern. The shape of the electrodes were rectangular with a length of 13 mm, a width of 0.9 mm and an interelectrode distance of 0.1 mm, and they were arranged in a number of 64.

The probes according to the present invention as shown in FIG. 1 through FIG. 3 were prepared by combining the polymeric thin film having thus formed electrodes for driving thereon and a common electrode previously formed on a copolymeric film or a common electrode formed on the polymeric thin film similarly as the electrodes for driving through the polymeric piezoelectric member. The polymeric piezoelectric member and the polymeric film were adhered with an epoxy type adhesive (301-2, trade name, produced by Epotech Co.), and further an expanded polyurethane supporting material (not shown) was plastered with the same adhesive on the acoustic non-actuating side to obtain a polymeric piezoelectric probe of the λ/2 type.

Figure 9:
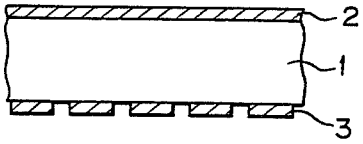
FIG. 9 PRIOR ART
FIG. 9 is a schematic illustration showing a polymeric piezoelectric ultrasonic probe having the constitution of the prior art used as a Comparative Example.

Further, by using the electrodes previously formed on the above copolymer film as such, a probe as shown in FIG. 9 was prepared by working according to etching as one is a common electrode and the other is an electrode for driving.

At the portion of the electrode for driving of these ultrasonic probes, through an anisotropic electroconductive film of the hot press adhesion type (CP 1030, trade name, produced by Sony Chemical), a lead wire was taken out with a flexible print substrate with a shape in conformity to the lead take-out portion of the inherent electrode pattern. In this Example, adhesion was effected by way of hot press adhesion at a temperature of 140° C. under a pressure of 70 kg/cm$^2$ for 15 seconds.

For the above ultrasonic probe, the actuation situation in a unit element was measured by use of an impedance analyzer (4191A, trade name, produced by YHP) and an ultrasonic probe evaluating apparatus (UTA-3, trade name, produced by Aerotech Co.). In this case, in the impedance analyzer, measurement was conducted primarily about whether the unit element completely actuated through the lead wire, while, in the ultrasonic probe evaluating apparatus, measurement was conducted primarily about the mean actuation central frequency ($f_0$), the sensitivity (dB) and the specific band region width ($\Delta f/f_0$) (a value in which the frequency range ($\Delta f$) of −10 dB is divided by the actuation central frequency ($f_0$) is defined) by analyzing the reflected wave from the acrylic block provided in water at a depth of 70 mm. The results of the average values are shown in Table 1.

TABLE 1

| Constitution | Actuation situation | Actuation central frequency ($f_0$) | Sensitivity (dB) | Specific band region width ($\Delta f/f_0$) |
|---|---|---|---|---|
| FIG. 1 | All elements actuated | 7.8 MHz | 31 dB | 0.68 |
| FIG. 2 | All elements actuated | 7.5 MHz | 30 dB | 0.72 |
| FIG. 3 | All elements actuated | 7.5 MHz | 30 dB | 0.72 |
| Control FIG. 9 | 17 of 64 elements not actuated | 8.2 MHz | 31 dB | 0.68 |

As apparently seen from the results, it can be understood that the polymeric piezoelectric ultrasonic probe of the present invention has very high reliability, with no breaking of electrodes, etc. being observed at all.

In the present measurement, measurement was performed in the unit element. When all of these elements were actuated in combination, 17 elements of 64 elements did not actuate in Control. In this case, there is a defect at a connecting portion of the lead wire due to anisotropic electroconductive film in the probe of the constitutional example as shown in FIG. 9.

EXAMPLE 2

A polymeric piezoelectric member was prepared by peeling off the electrodes of a film consisting of a $PVF_2$.TrFE copolymer with a thickness of 45 μm previously applied with polarizing treatment. On the other hand, as the electrodes for driving, silver was vapor deposited to a thickness of about 1 μm on a polyimide film (Kapton 30H, trade name, produced by Toray), followed further by etching to form electrodes inherently patterned in 64 rectangular shaped with an electrode length of 20 mm, a width of 1.02 mm and an interelectrode distance of 0.1 mm. Further, on one surface of another polyimide film (Kapton 50H, trade name, produced by Toray), a common electrode with an electrode shape of 20 mm×73 mm was formed according to the same method.

By use of the thus obtained polymeric piezoelectric member, polymeric thin film having electrodes for driving formed thereon and polymeric thin film having a common electrode formed thereon, polymeric piezoelectric probes of the λ/4 type having constitutions as shown in FIG. 4 through FIG. 8 were prepared. In this case, a copper plate was used for each of the λ/4 acoustic reflection plates, and the thickness of the copper plate was made 100 μm in the constitutions as shown in FIG. 4 and FIG. 5, while it was made 150 μm in the constitutions as shown in FIG. 6 through FIG. 8, and an epoxy type adhesive (301-2, trade name, produced by Epotech Co.). Also, in the constructions as shown in FIG. 6 through FIG. 8, the polarizing directional axes were made the laminated type opposed to each other.

The common electrode portion and the λ/4 acoustic reflection plate as shown in FIG. 4 through FIG. 8 were connected (at both end portions) to each other with an epoxy type electroconductive adhesive (D-753, trade name, produced by Fujikura Kasei), and an acrylic resin was used as the back supporting material (not shown) for supporting the polymeric piezoelectric member.

The λ/4 type polymeric piezoelectric ultrasonic probes thus obtained were measured according to the same method as in Example 1 to obtain the results as shown in Table 2.

TABLE 2

| Constitution | Actuation situation | Actuation central frequency ($f_0$) | Sensitivity (dB) | Specific band region width ($\Delta f/f_0$) |
|---|---|---|---|---|
| FIG. 4 | All elements actuated | 10.7 MHz | 38 dB | 0.66 |
| FIG. 5 | All elements actuated | 10.2 MHz | 38 dB | 0.75 |
| FIG. 6 | All elements actuated | 5.2 MHz | 35 dB | 0.68 |
| FIG. 7 | All | 5.2 MHz | 35 dB | 0.74 |

TABLE 2-continued

| Constitution | Actuation situation | Actuation central frequency ($f_0$) | Sensitivity (dB) | Specific band region width ($\Delta f/f_0$) |
|---|---|---|---|---|
| | elements actuated | | | |
| FIG. 8 | All elements actuated | 5.2 MHz | 35 dB | 0.79 |

In the λ/4 type polymeric piezoelectric ultrasonic probes obtained in this Example, all the elements were actuatable with no breaking of electrodes, etc. being observed at all. Even in the case of the laminated type, since the probe of the present invention has the electrodes for driving previously formed on a polymeric thin film without deviation in position, no deviation in position of the electrodes as observed in the probe of the prior art will occur, whereby not only variance in electrical impedance of the polymeric piezoelectric member generated with such a deviation in position, acoustic-electrical coupling, further influence of cross talk and short circuit can be prevented, but also a highly reliable lead wire connection can be obtained.

EXAMPLE 3

A polyimide film (Kapton 30H, trade name, produced by Toray) as the polymeric thin film was cut to a predetermined size (60×240 mm), and then silver was applied by vacuum vapor deposition to a thickness of about 1 to 2 μm wholly over the both surfaces.

Figure 45:
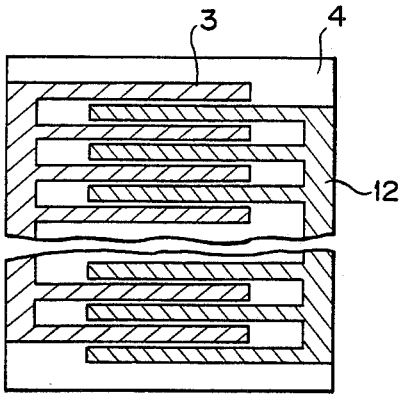
FIG. 45 is a schematic illustration showing the shape of electrodes for driving having the common electrode for formation of the thick film portion as shown in an Example.

Subsequently, a number of rectangular electrodes for driving as shown in FIG. 45 were formed. In this Figure, on the polymeric film 4, electrodes for driving 3 are formed. The size of the acoustic actuating portion of the electrode for driving was 20 mm in electrode length, 1.02 mm in electrode width and 0.1 mm in interelectrode distance, and the number of electrodes for actuation was made 64. In this Example, a common electrode 12 was also formed with a width of 5 mm in order to be used for making thicker the end portion of the film. The common electrode 12 was removed after formation of the thick film portion.

And, of the rectangular electrodes for driving, the acoustic actuating portions not required to be made thicker are coated with a resist material and then applied with copper plating treatment. Copper plating was effected by use of an acidic solution of copper sulfate/sulfuric acid system at a temperature of 40° C. and a current density of 2 A/dm$^2$ for 10 minutes. As a result, the film thickness of copper by copper plating became about 40 μm, thus making the end portions of electrodes for driving thicker.

After completion of plating treatment, the resist material previously applied was removed with acetone, and further the common electrode pattern portion of the electrode portions for driving used in plating treatment was cut off to obtain electrodes for driving having thick film portions with a width of 3 mm at the end portions.

Next, polymeric $PVF_2$, TrFE piezoelectric members with a thickness of 45 μm previously applied with polarizing treatment were set with the polarizing axis directions as opposed to each other, and the above polymeric thin film having a number of rectangular electrodes for driving having lead wires connected thereto was interposed between the polymeric piezoelectric members. On the acoustic actuating side of the polymeric piezoelectric member was arranged a common electrode 2 and on the acoustic non-actuating side a copper plate with a thickness of 150 μm as the λ/4 plate also functioning as the common electrode 6. In this case, the common electrode and the λ/4 plate also functioning as the common electrode was made to have a shape conforming to the acoustic actuating portion of the driving electrode. And, the polymeric piezoelectric members, the polymeric thin film having formed electrodes for driving thereon, the common electrode and the λ/4 plate also functioning as the common electrode were adhered with an epoxy type adhesive (301-2, trade name, produced by Epotech Co.) to obtain an acoustically integrated polymeric piezoelectric ultrasonic probe.

The lead portion of the probe was connected with a solder 9 by superposing the thick copper film portion at the end portion of the electrode for driving previously provided and the lead wire 8 of the polyimide type flexible print substrate 7 made equal in shape to the rectangular electrode for driving. Thus, the lead wire in the present invention exhibits also the electroconductive portion formed on the substrate.

When the actuation situation of the polymeric piezoelectric ultrasonic probe was measured by means of an impedance analyzer (4192A, trade name, produced by YHP) and an ultrasonic probe evaluating apparatus (UTA-3, trade name, produced by Aerotech Co.), it was confirmed that all of the 64 elements completely actuated through the lead wires.

EXAMPLE 4

Figure 46:
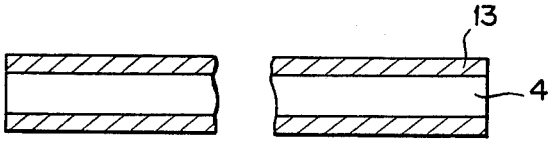
FIG. 46 through FIG. 48 are schematic sectional views showing the processes for formation of thick film portions in other Examples.
Figure 47:
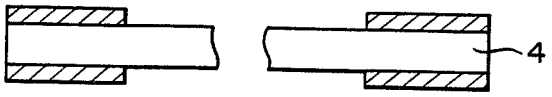
Figure 48:
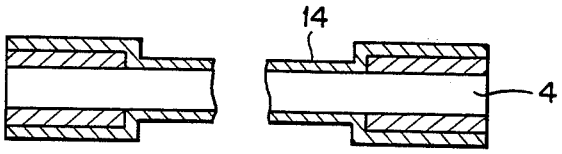

After both surfaces of a polyimide film (Kapton 30H, trade name, produced by Toray) as the polymeric thin film 4 were treated with a 5% caustic soda solution, electroless copper plating was applied thereon, followed further by the same copper plating treatment as practiced in Example 3 to provide a thick copper film 13 with a thickness of about 40 μm over the entire surface (FIG. 46). Next, the central portion of above thick copper portion was removed by etching to provide elecrodes for driving (FIG. 47), and thereafter a silver film 14 with a thickness of about 2 μm was provided on the entire surface by vacuum vapor deposition (FIG. 48). Then, by etching, a number of rectangular electrodes for driving (shape of acoustic actuating portion: electrode length 20 mm, electrode width 1.02, interelectrode distance 0.1 mm, number of electrodes for driving 64).

As the next step, polymeric $PVF_2$, TrFE piezoelectric members with a thickness of 45 μm previously applied with polarizing treatment were set with the polarizing axis directions as opposed to each other, and the polymeric thin film having a number of rectangular electrodes for driving having lead wires connected thereto was interposed between the polymeric piezoelectric members in the same manner as in Example 3. On the acoustic actuating side of the polymeric piezoelectric member was arranged a common electrode consisting of a vapor deposited film of silver and on the acoustic non-actuating side a copper plate with a thickness of 150 μm as the λ/4 plate also functioning as the common electrode. In this case, the common electrode and the λ/4 plate also functioning as the common electrode was made to have a shape conforming to the acoustic actuating portion of the driving electrode. And, the polymeric piezoelectric members, the polymeric thin film having formed electrodes for driving thereon, the common electrode and the λ/4 plate also functioning as the common electrode were adhered with an epoxy type adhesive (301-2, trade name, produced by Epotech Co.) to obtain an acoustically integrated polymeric piezoelectric ultrasonic probe.

The lead portion of the probe was connected with a solder by superposing the thick copper film portion at the end portion of the electrode for driving previously provided and the lead wire of the polyimide type flexible print substrate made equal in shape to the individual rectangular electrode for driving.

When the actuation situation of the polymeric piezoelectric ultrasonic probe was measured by means of an impedance analyzer (4192A, trade name, produced by YHP) and an ultrasonic probe evaluating apparatus (UTA-3, trade name, produced by Aerotech Co.), it was confirmed that all of the 64 elements completely actuated through the lead wires.

EXAMPLE 5

Figure 49:
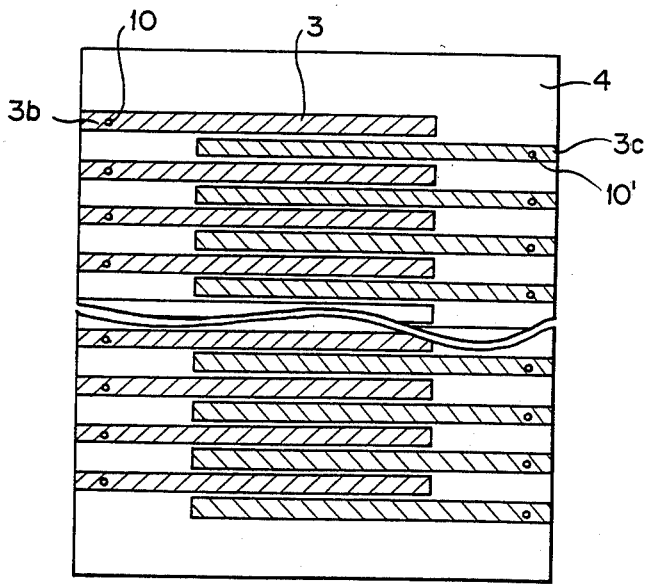
FIG. 49 is a plan view showing an Example of the present invention.

Referring now to FIG. 14, FIG. 15 and FIG. 49, an example of the polymeric piezoelectric ultrasonic probe is to be described.

In FIG. 14, first, as the polymeric piezoelectric members 1 and 1', films consisting of $PVF_2$.TrFE copolymer with a thicknes of 40 μm previously applied with polarizing treatment were employed and arranged so that their polarizing axes were opposed to each other. In the Figure, the upper portion shows the side at which the acoustic propagating body is positioned, namely the acoustic actuating side, and the lower portion corresponds to the acoustic non-actuating side. And, between the polymeric piezoelectric members 1 and 1', a polymeric thin film 4 having electrodes 3 and 3' formed thereon was interposed.

For the polymeric thin film 4, a polyimide film (Kapton 30H, trade name, produced by Toray K. K.) was used and first, as shown in FIG. 49, thru-holes 10 and 11 with a diameter of 0.5 mmϕ and a pitch 1.12 mm were formed by, for example, laser working at the sites corresponding to the predetermined positions for rectangular electrodes as hereinafter described. Subsequently, a silver layer with a thickness of 1 μm was formed wholly over the both surfaces of the polymeric thin film by application of the vacuum vapor deposition method, followed by patterning, as shown in FIG. 49, by way of etching of the silver layer to make the acoustic actuating region shaped in a number of rectangular electrodes with an electrode length of 20 mm and an electrode distance, which were arranged in a number of 64 with an interelectrode distance of 0.1 mm. From the above steps, electrodes for driving of which upper and lower portions were connected electrically through the thru-holes formed at portions 5 mm from the end portion of the electrodes for driving and at the center in the width direction were obtained.

As shown in FIG. 14, the electrodes for driving 3 were adhered to a polyimide type flexible print substrate having the same shape as the electrodes for driving through an anisotropic electroconductive adhering connector with a width of 3 mm by applying the hot press method, namely by effecting hot press adhesion under the conditions of a temperature of 140°±5° C. and a pressure of 45 kg/cm$^2$ for 10 seconds. The contact resistance of the electrodes for driving and the polyimide type flexible print substrate was found to be as small as 4 to 5Ω, while the insulating resistance between the electrodes for driving was $2\times10^{12}$ Ω.

Subsequently, on the surface on the acoustic actuating side (upper surface) of the polymeric piezoelectric member 1 was formed a common electrode 2 consisting of silver with a thickness of about 1 μm on the entire surface of the region corresponding to the acoustic actuating portions of the electrodes for driving 3 and 3', while on the surface on the acoustic non-actuating side (lower surface) of the polymeric piezoelectric member 1' was formed a λ/4 plate 6 (also functioning as the common electrode) consisting of a copper plate with a thickness of about 150 μm having the same shape as the common electrode 2. The λ/4 plate 6 and the common electrode 2 are electrically connected and are each grounded. And, the polymeric piezoelectric members 1 and 1', the polymeric thin film 4 having electrodes for driving 3 and 3' formed thereon and the polymeric piezoelectric 1' and the λ/4 plate 6 were asdhered, respectively, with epoxy type adhesives 5 and 5' (301-2, trade name, produced by Epotech Co.) to complete the polymeric piezoelectric ultrasonic probe of the present invention.

The actuation situation of the polymeric piezoelectric ultrasonic probe thus obtained was measured by means of an impedance analyzer (4192A, trade name, produced by YHP) and an ultrasonic probe evaluating apparatus (UTA-3, trade name, produced by Aerotech Co.). As a result, it was confirmed that all of the 64 elements completely actuated through the lead wires. First, when the reflected wave from the acrylic block provided in water at a depth of 70 mm was analyzed, the average central frequency of the actuating element was found to be 5.2 MHz, with its sensitivity being 36 dB and variance of the actuating element within 5%, whereby it was confirmed that reliability was very high.

EXAMPLE 6

A polymeric piezoelectric ultrasonic probe as shown in FIG. 17 was prepared in the following manner. That is, first, the electrodes on both surfaces of a film consisting of a PVDF type copolymer with a thickness of 75 μm previously applied with polarizing treatment were peeled off to prepare a polymeric piezoelectric member 1. Then, as electrodes for driving 3 silver was vapor deposited to a thickness of about 1 μm on a polyimide film 4 (Kapton 50H, trade name, produced by Toray K. K.) to form an inherent pattern electrode 3 by way of etching and a common electrode take-out portion 17. The shape of the electrode 3 was made rectangular with a length of 13 mm and a width of 0.9 mm and such electrodes were arranged in a number of 64 with an interelectrode distance of 0.1 mm. Also, the common electrode lead take-out portion 17 was made to have a length of 13 mm and a width of 3 mm. And, as the common electrode 2, a copper plate of 13 mm×70 mm×0.17 mm was prepared.

Then, as shown in FIG. 18, at the brim portion of the common electrode take-out portion, four spots 18 with a diameter of about 2 mm were formed at an interval of about 1 mm with an instantaneously curing type electroconductive adhesive (Sicolon B). And, these polyimide film 4, PVDF type polymeric piezoelectric member 1 and copper plate 2 were adhered with an epoxy type adhesive (301-2, trade name, produced by Epotech Co.) 5 to have a structure as shown in 19, and further an acrylic resin was secured on the back surface thereof as the supporting member. Thereafter, to the electrodes 3 for driving and the common electrode lead take-out portion 17 was adhered a flexible print plate having a lead portion with the same shape as these thereon through a hot press adhesion type anisotropic electroconductive film (CP 1030, trade name, produced by Sony Chemical). This adhesion step was practiced by hot press adhesion at a temperature of 140° C. and a pressure of 70 kg/cm$^2$ for 15 seconds.

The actuation situation of the ultrasonic probe obtained as described above was measured by an impedance analyzer (4192A, trade name, produced by YHP) to confirm that reliability was very high with the average resonance frequency being 7.6 MHz and the variance of the characteristics of the actuating element being within 5%.

EXAMPLE 7

A laminated polymeric piezoelectric ultrasonic probe as shown in FIG. 20 was prepared. First, as the polymeric piezoelectric members 1' and 1'', films of the PVDF type copolymer applied with polarizing treatment similarly as in the above Example 6 were employed, and each film was made to have a thickness of 38 μm. As the polymeric thin films 4' and 4'', a polyimide film (Kapton 30 H, trade name, produced by Toray) was employed, and on the polyimide film 4' were formed electrodes 3 and 3' shaped in rectangular shape of 20 mm in length and 1.02 mm in width in a number of 192 with a distance of 0.1 mm, respectively, and further the common electrode lead take-out portions 17' and 17'' with a length of 20 mm and a width of 3 mm were formed in the same manner as described above. On the other hand, on the polyimide film 4'', a common electrode 2' of 20 mm×230 mm was formed similarly. Further, as the λ/4 plate 6' functioning also as the common electrode, a copper plate with a thickness of 150 μm was prepared.

Then, on the brim portions of the common electrode lead take-out portions 17' and 17'' and the brim portion of the common electrode 2, spots 18' and 18'' consisting of an electroconductive adhesive as shown in FIG. 21 were formed, and the respective layers were adhered with an adhesive 5' to give a structure as shown in FIG. 22, followed by hot press adhesion of the flexible print substrate similarly as described above.

When the ultrasonic probe having a laminated structure as prepared above was measured by the same impedance analyzer (4192A, trade name, produced by YHP) as in the above Example 6, it was confirmed that reliability was very high with the average resonance frequency being 5.1 MHz and the variance in characteristics of the actuating element being within 5%.

EXAMPLE 8

With reference to FIG. 25 and FIG. 26, an example of the polymeric piezoelectric ultrasonic probe is to be described.

In the Figures, first, as the polymeric piezoelectric members 1'' and 1''', films consisting of $PVF_2$.TrFE copolymer with a thicknes of 40 μm previously applied with polarizing treatment were employed and arranged so that their polarizing axes were opposed to each other. In the Figures, the upper portion shows the side at which the acoustic propagating body is positioned, namely the acoustic actuating side, and the lower portion corresponds to the acoustic non-actuating side. And, between the polymeric piezoelectric members 1'' and 1''', a polymeric thin film 4 having electrodes 3 and 3' formed thereon was interposed. For the polymeric thin film 4, a polyimide film (Kapton 30H, trade name, produced by Toray K. K.) was used and a silver layer with a thickness of 1 μm was formed wholly over the both surfaces of the polymeric thin film by application of the vacuum vapor deposition method, followed by patterning by way of etching of the silver layer to make the acoustic actuating region shaped in a number of rectangular electrodes with a length of 20 mm and a width of 1.02 mm, which were arranged in a number of 64 with an interelectrode distance of 0.1 mm.

Then, on the surface on the acoustic actuating side of the polymeric piezoelectric member 1'' (upper surface), a common electrode 2 consisting of silver with a thickness of 1 μm was formed on the whole regional surface corresponding to the acoustic actuating portions of the electrodes for driving 3 and 3', while, on the acoustic non-actuating side of the polymeric piezoelectric member 1''', a λ/4 plate 6' (also functioning as the common electrode) made of a copper plate with a thickness of about 150 μm having the same shape as the common electrode 2 was formed. The λ/4 plate 6' and the common electrode 2 were electrically connected and each grounded. And, the polymeric piezoelectric members 1'' and 1''', the polymeric thin film 4 having electrodes 3 and 3' formed thereon, and the polymeric piezoelectric member and the λ/4 plate 6', respectively, were adhered with each other through epoxy type adhesives 5, 5' and 5'' (301-2, trade name, produced by Epotech Co.) to complete the polymeric piezoelectric ultrasonic probe of the present invention.

In such a polymeric piezoelectric ultrasonic probe, the shape of the polymeric piezoelectric members 1'' and 1''', as also apparent from FIG. 26, was set so that it became further greater by about 5 mm on the left and right sides in the drawing than the end portions of the acoustic actuating regions of the electrodes for driving 3 and 3' along the lontigudinal direction of the electrodes for driving 3 and 3'.

The polymeric piezoelectric ultrasonic probe of the present invention thus obtained was secured on its acoustic non-actuating side onto the back supporting plate made of an acrylic resin (not shown), and further to the electrodes for driving 3 and 3' was adhered through a hot press adhesion type anisotropic electroconductive film (CP 1030, trade name, produced by Sony Chemical) a flexible print plate having a lead wire pattern with a shape conforming to the lead take-out portion of the rectangular electrode pattern formed thereon to take out lead wires. In carrying out adhesion, the anisotropic electroconductive film was subjected to hot press adhesion at a temperature of 140° C. and a pressure of 70 kg/cm$^2$ for 15 seconds.

For the above ultrasonic probe, the actuation situation in the unit element was measured by means of an impedance analyzer (4192A, trade name, produced by YHP) and an ultrasonic probe evaluating apparatus (UTA-3, trade name, produced by Aerotech Co.). In this case, in the impedance analyzer, measurement was conducted primarily about whether the unit element actuated completed through the lead wire, while in the ultrasonic probe evaluating apparatus, the reflected wave from the acrylic block provided in water at a depth of 70 mm was analyzed to measure primarily the actuation situation of the actuating element, namely presence of short circuit, breaking of elements among 64 elements, average actuating central frequency ($f_0$), sensitivity (dB), band region (the frequency range of −10 dB relative to the actuating central frequency is defined by $\Delta f/f_0$). The results are shown in Table 3.

TABLE 3

| | Example |
|---|---|
| Actuating central frequency ($f_0$) | 5.2 MHz |
| Sensitivity (dB) | 35 |
| Band region ($\Delta f/f_0$) | 0.76 |
| Actuating situation | All elements actuated |

As is apparent from the above description, the polymeric piezoelectric ultrasonic probe, since it is made to have at least a part of the polymeric piezoelectric member extended in the direction of electrodes for driving having an inherent shape, for example, rectangular electrodes from the electrode end portions of the rectangular electrodes, breaking, etc. by short circuit of the λ/4 plate and the electrodes for driving or mechanical contact with the λ/4 plate will not be generated even when more or less deviation in position may occur between the λ/4 plate and the polymeric piezoelectric member, whereby a polymeric piezoelectric ultrasonic probe with very high reliability can be obtained.

EXAMPLE 9

A polymeric piezoelectric member was prepared by removing the aluminum electrodes used for polarizing treatment by etching from the both surfaces of a film consisting of a PVDF type copolymer with a thickness of 37 μm applied previously with polarizing treatment. Next, as electrodes for driving, silver was vapor deposited in vacuo to a thickness of about 1 μm on both surfaces of a polyimide film (Kapton 30H, trade name, produced by Toray) and etched to provide electrodes shaped in rectangular strips (shape of acoustic actuating portion: electrode length 20 mm, electrode width 1.02 mm, interelectrode distance 0.1 mm, number of electrodes for driving 64). Also, on one surface of the polyimide film (Kapton 30H, trade name, produced by Toray), silver was vapor deposited and etched to provide a common electrode (20 mm×67.32 mm). As the other common electrode functioning also as the λ/4 acoustic reflective plate, a copper plate with a thickness of 150 μm having the same shape (20 mm×67.32 mm) as the previously prepared common electrode was prepared.

As the next step, after two sheets of the polymeric piezoelectric member were arranged so that the polarizing axis directions may be opposed to each other as shown in FIG. 27, the polymeric thin film provided with the electrodes for driving was sandwitched between the piezoelectric members, and further the first common electrode provided on the polyimide and the common electrode functioning also as the λ/4 acoustic reflecting plate made of the copper plate were arranged as opposed to the electrodes for driving through the intermediary polymeric piezoelectric member.

The first common electrode and the common electrode functioning also as the λ/4 acoustic reflective plate having the same shape were arranged so that they were not protruded from each other as viewed from the laminated direction.

Further, on the back of the common electrode functioning also as the λ/4 acoustic reflective plate, an acrylic supporting material having a radius of curvature of 100 mm was placed. Then, for registration of the common electrode and the common electrode functioning also as the λ/4 acoustic reflective plate, a part of its end portion was fixed by an instantaeous adhesive (Allon-alpha, trade name, produced by Toa Gosei) so that protruded portion through deviation in position was not formed, and further adhesion was effected with an epoxy type adhesive (301-2, trade name, produced by Epotech Co.) to obtain an acoustically integrated polymeric piezoelectric ultrasonic probe.

In the probe of Example, lead wires from the electrodes for driving were taken out by a flexible print substrate of the shape conforming to the lead take-out portions of the electrode pattern for driving through a hot press adhesion type anisotropic electrodoncutive film (CP 1030, trade name, produced by Sony Chemical).

For the probe of Example, characteristic capacitance and resonace freuency were measured by an impedance analyzer (4192A, trade name, produced by YHP), and also the actuating characteristic by an ultrasonic probe evaluating apparatus (UTA-3, trade name, produced by Aerotech Co.). In this case, in the ultrasonic probe evaluating apparatus, the reflected wave from the acrylic block provided in water at a depth of 70 mm was analyzed for measurement primarily of the average actuating central frequency ($f_0$) and sensitivity of the actuating element, and the receiving wave form was observed.

The average values of the results are shown in Table 4.

TABLE 4

| | Resonance frequency (fr:MHz) | Capacitance during fr (pF) | Actuating central ($f_0$:MHz) | Sensitivity (dB) | Receiving wave form |
|---|---|---|---|---|---|
| Example | 5.3 ± 0.1 | 64 ± 2 | 5.5 ± 0.1 | 35 ± 2 | Good |

The probe obtained in this Example has the common electrode and the common electrode functioning also as the λ/4 acoustic reflective plate which are the same in shape, and therefore little in change of frequency of the ultrasonic wave accompanied by change in electrical impedance or ununiformization of the vibrating mode and can exhibit good actuating characteristics.

EXAMPLE 10

A polymeric piezoelectric member was prepared by removing the aluminum electrodes used for polarizing treatment by etching from the both surfaces of a film consisting of a PVDF type copolymer with a thickness of 37 μm applied previously with polarizing treatment. Next, as electrodes for driving, silver was vapor deposited in vacuo to a thickness of about 1 μm on both surfaces of a polyimide film (Kapton 30H, trade name, produced by Toray) and etched to provide electrodes shaped in rectangular strips (shape of acoustic actuating portion: electrode length 24 mm, electrode width 1.02 mm, interelectrode distance 0.1 mm, number of electrodes for driving 64). Thus, the electrode length of the electrodes for driving was made greater as 24 mm than the width 20 mm of the corresponding common electrode and the common electrode functioning also as the λ/4 acoustic support. Also, on one surface of the polyimide film (Kapton 30H, trade name, produced by Toray), silver was vapor deposited and etched to provide a common electrode (20 mm×67.32 mm). As the other common electrode functioning also as the λ/4 acoustic reflective plate, a copper plate with a thickness of 150 μm having the same shape (20 mm×67.32 mm) as the common electrode was prepared.

After these were arranged so that the polarizing axes of the polymeric piezoelectric members 1 and 1' might be opposed to each other as shown in FIG. 30, the polymeric thin film 4 provided with the electrodes for driving was sandwitched between the piezoelectric members, and further the first common electrode 2 provided on the polyimide film which was the polymeric thin film 4 and the common electrode 2' functioning also as the λ/4 acoustic reflecting plate made of the copper plate were arranged on the both sides thereof and adjusted in position so that both common electrodes conformed to each other. On the back of the common electrode functioning also as the λ/4 acoustic support, an acrylic supporting material having a curvature of radius of 100 mm was provided.

Then, for preventing the common electrode and the common electrode functioning also as the λ/4 acoustic reflective plate from deviation in position, their end portions were partially fixed by an instantaeous adhesive (Allonalpha, trade name, produced by Toa Gosei), and further adhesion was effected with an epoxy type adhesive (301-2, trade name, produced by Epotech Co.) to obtain an acoustically integrated polymeric piezoelectric ultrasonic probe.

In this case, as mentioned above, since the electrode length of the electrodes for driving was larger than the width of the common electrode and the common electrode functioning also as the λ/4 acoustic support, the common electrode and the common electrode functioning also as the λ/4 acoustic support were completely opposed to the electrodes for driving, whereby there was no portion having no corresponding opposed electrode.

In the probe of Example, lead wires from the electrodes for driving were taken out by a flexible print substrate of the shape conforming to the lead take-out portions of the electrode pattern for driving through a hot press adhesion type anisotropic electroconductive film (CP 1030, trade name, produced by Sony Chemical).

The characteristic capacitance (pF) and resonance frequency (fr) were measured by an impedance analyzer (4192A, trade name, produced by YHP), and also the actuating characteristic by an ultrasonic probe evaluating apparatus (UTA-3, trade name, produced by Aerotech Co.). In this case, in the ultrasonic probe evaluating apparatus, the reflected wave from the acrylic block provided in water at a depth of 70 mm was analyzed for measurement primarily of the average actuating central frequency ($f_0$) and sensitivity of the actuating element, and the receiving wave form was observed. The results are shown in Table 5.

TABLE 5

| | Resonance frequency (fr:MHz) | Capacitance during fr (pF) | Actuating central ($f_0$:MHz) | Sensitivity (dB) | Receiving wave form |
|---|---|---|---|---|---|
| Example | 5.3 ± 0.1 | 64 ± 2 | 5.5 ± 0.1 | 35 ± 2 | Good |

The probe obtained in this Example, as seen from the above results, is little changed in electrical impedance, has good receiving wave form, and also shows little change in frequency accompanied with a non-uninform vibration mode and is further high is sensitivity.

EXAMPLE 11

Figure 50:
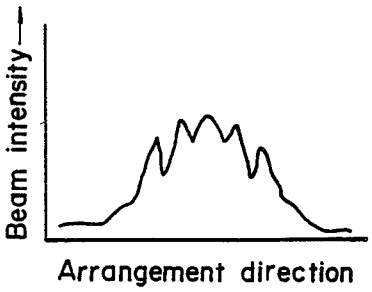
FIG. 50 and FIG. 51 are ultrasonic beam patterns of the ultrasonic probes prepared for trial.
Figure 51:
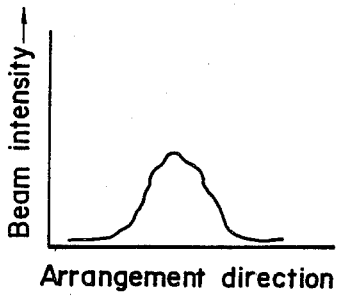

A linear array type ultrasonic probe of 5 MHz, 64 ch with the use of a polymeric piezoelectric member was prepared for trial. The polymeric piezoelectric member employed consisted of two sheets laminated of a polyvinylidene film with a thickness of 56 μm, and a λ/4 thick copper plate was adhered thereto as the acoustic reflective plate. The electrode length was 13 mm, the electrode width 0.9 mm and the interelectrode distance 0.1 mm. For comparison, for the both cases of a drum type inductor and a troidal type inductor, their sound field patterns were examined. Each inductor was mounted on a flexible print substrate and connected on the vibrator side. As the target, a tungsten wire of 100 μm in diameter was used and placed in water. On the ultrasonic wave, an impulse voltage of about 200 V was applied to radiate ultrasonic wave into water and the wave form reflected from the above target was determined. The target was placed in parallel to the direction in which the driving elements were arranged and moved in the same arranged direction. As the sound field pattern, the reflected wave was detected and then amplified by a logarithmic amplifier. FIG. 50 and FIG. 51 show the sound field patterns when employing drum type inductor and a troidal type inductor, respectively, in which the axis of abscissa indicates the direction in which the elements are arranged and the axis of ordinate beam intensity. It can be seen that a sound field pattern with little crosstalk is obtained by use of a troidal type inductor.

EXAMPLE 12

A polymeric piezoelectric ultrasonic probe as shown in FIG. 10 with a central frequency of 5 MHz and an element number of 64 was prepared for trial. As the polymeric piezoelectric members 1 and 1', a $PVF_2$ film with a thickness of 37 μm was used and adhered on a copper plate with λ/4 thickness as the acoustic reflective plate 6. The length of the electrode for driving 3 was made 13 mm, the width 0.9 mm and the interelectrode distance 0.1 mm. And, an inductor was connected between the electrode 3 and the electrode terminal.

Evaluation was conducted according to the method using a UTA-3 (trade name, produced by Aerotech Co.) which a standard pulser receiver as the driving circuit and the receiving circuit by receiving the reflected wave from the acrylic block placed in water at a depth of 7 cm and measuring sensitivity from the wave height value of the reflected wave, and also measuring the central frequency ($f_0$) from the frequency spectrum and the frequency (Δf) at −20 dB region from $f_0$ whereby measuring the specific band region width ($\Delta f/f_0$). The results of measurement of these sensitivity and specific band region width by varying inductance values are shown in Table 6.

TABLE 6

| Inductance value [μH] | Sensitivity [dB] | Specific band region width [$\Delta f/f_0$] |
|---|---|---|
| 0 | 0 | 0.64 |
| 15 | 0.27 | 0.70 |
| 18 | 1.79 | 0.72 |
| 22 | 3.20 | 0.67 |
| 26 | 5.50 | 0.59 |
| 39 | 6.15 | 0.38 |

TABLE 6-continued

| Inductance value [μH] | Sensitivity [dB] | Specific band region width [Δf/f0] |
|---|---|---|
| 56 | 5.60 | 0.35 |

In Table 6, the inductance value 39 μH is the value giving the highest sensitivity, but when employing an inductance value within the scope based on the present invention, for example, 26 μH which is 67% of 39 μH, the specific band region width is improved to a great extent as 1.56-fold, although the sensitivity is lowered by 0.65 dB.

Figure 52:
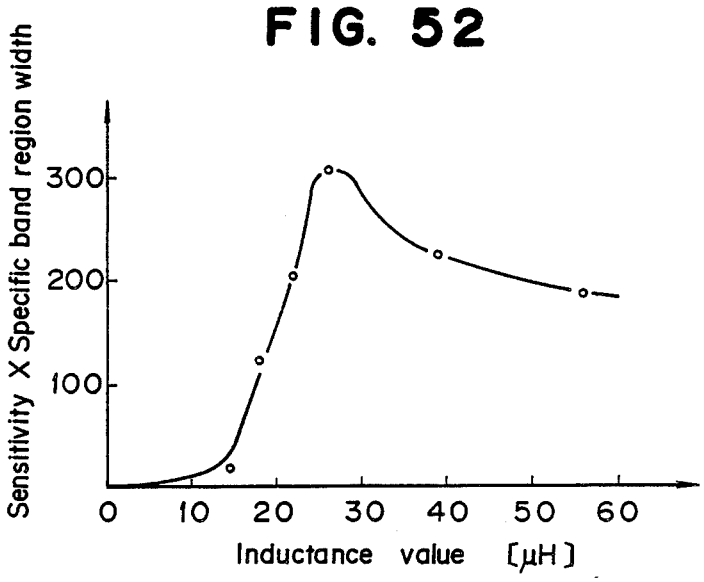
FIG. 52 is a chart showing the relationship of the product of sensitivity-specific band region versus change in the inductance value.

FIG. 36 is a graphic representation of the relationship between the sensitivity and the specific band region width thus measured. Also, FIG. 52 shows the relationship of the product of sensitivity×specific band region width versus inductance value. The present invention, in other words, chooses an inductance value in the vicinity of the point where the product of sensitivity×specific band region width becomes maximum.

Thus, according to the present invention, a polymeric piezoelectric ultrasonic probe can be provided which is high in sensitivity and yet broad in specific band region width, thus being good in S/N ratio and also high in distance resolving ability.

EXAMPLE 13

Figure 53:
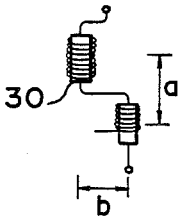
FIG. 53 and FIG. 54 are charts showing arrangement of the coils for examination of mutual induction of coils.
Figure 54:
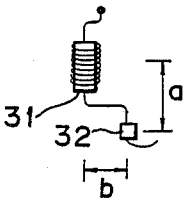

The extent of mutual induction of a drum type coil was examined. As shown in FIG. 53 and FIG. 54, in the same relationship as in the practical linear array ultrasonic probe (a is 6 mm and b is 5 mm), and, as to their arrangement, the case when the central axes of the coils 30, 31 and 32 are in parallel to each other and the case when they are perpendicular to each other were considered. In carrying out the test, a double-coated tape was plastered on a glass epoxy substrate 7, and both of the linear array ultrasonic probes as shown in FIG. 53 and FIG. 54 were measured by use of an impedance analyzer (4192A, trade name, produced by YHP) at 5 MHz and 1 Vpp. The results are shown in Table 7. In spite of using the same coil, there was a difference in inductance value between the probes shown in the above Figures. In the case of the probe shown in FIG. 54, the inductance value was approximately the same to the sum of the inductance values measured for each one element, while the inductance value is greater than such sum of individual values in the case of the probe shown in FIG. 53, which may be considered as a result of mutual induction.

TABLE 7

| No. | Inductance [μH] | Sum of L (calculated) | The case of FIG. 53 | The case of FIG. 54 |
|---|---|---|---|---|
| 1 | 12.10 | 24.38 | 25.58 | 24.40 |
| 2 | 12.28 | | | |

EXAMPLE 14

Figure 55:
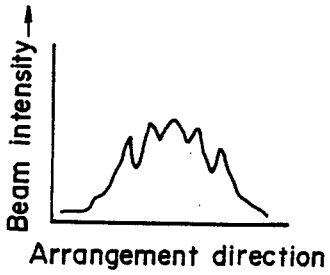
FIG. 55 and FIG. 56 are characteristic charts showing the ultrasonic beam patterns when the coils are arranged in parallel and when the coils are arranged so as to cross each other at right angles, respectively.
Figure 56:
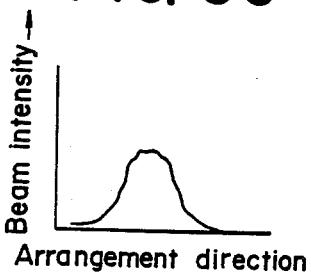

A linear array type ultrasonic probe was prepared from a $PVF_2$.TrFE type copolymer containing vinylidene fluoride and ethylene trifluoride having an electromechanical coupling coefficient of 21%. This probe was found to be markedly influenced by the cross-talk by the coils, and the sound field characteristics directly concerned with image characteristics were examined. The specification of the ultrasonic probe was 5 MHz of frequency, 64 channels, 13 mm of electrode length, 0.9 mm of electrode width and 0.1 mm of interelectrode distance. The measured item was the echo from the tungsten wire of 100 μm in diameter placed in water at a depth of 10 mm. Measurement was conducted by first applying a pulse voltage approximate to the impulse of 200 V, detecting the echo wave form, then passing it through a logarithmic amplifier and recording its output. The results are shown in FIG. 55 and FIG. 56. FIG. 55 shows the case in which the coils were arranged with their central axes in parallel to each other. FIG. 56 shows the case when the coils were arranged with their central axes being crossed with each other at right angle according to the present invention. As compared with the disturbed sound field pattern in the case of parallel arrangement, there is substantially no disturbance in the case of the arrangement crossed at right angle.

EXAMPLE 15

Description is made of the case of a polymeric piezoelectric member in which an ultrasonic probe using a PVDF type copolymer with an electromechanical coupling coefficient kt=24% was connected to a cable.

The ultrasonic probe had a structure consisting of respective vibrators each with a shape of a rectangular strip of 20 mm in length and 1.02 mm in width, which are juxtaposed in a number of 192 at an interval of 0.01 mm, namely a linear array type with 192 channels. And, the ultrasonic probe was designed to have a central frequency of 5 MHz. Further, a coil (12 μH) and a transformer (turns ratio 1:2.5) were employed for impedance matching with the power source, and these were placed on a glass epoxy substrate together with the above vibrators. And, for connection of these vibrators to the cable, 34-pin connectors (HIF3E-34P-2.54DS, trade name, produced by Hirose Denki) were used in a number of 6.

On the other hand, as the cable, 3 double shield cables with 64 cores (BSM30-1910, 110 pF, trade name, produced by Furukawa Denko) were prepared and each was made to have a length of 2.4 m.

At the tip end portion of each of such cables, as shown in FIG. 43, the exposed portion 39*a* of the core wire coated layer was set at a length A=5 mm and the earth wire take-out portion at a length B=10 mm. Then, each cable was connected to a connector socket as shown in FIG. 44, for example 34-pin connector 43 (HIF3C-34D-2.54C, trade name, produced by Hirose Denki) (used in a number of 6), and further the earth wire take-out portion 40*a* was soldered onto the copper plate 44 on the side surface. Thereafter, six 34-pin connectors and the aforesaid six pin connectors on the driving member side were connected to each other.

Figure 57:
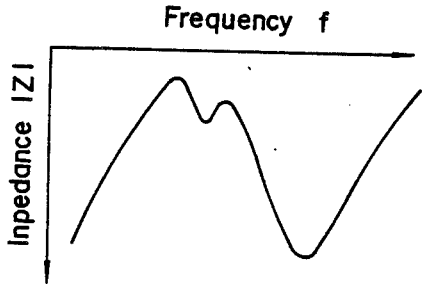
FIG. 57 and FIG. 58 are charts showing the impedance characteristic and the pulse echo characteristic of the ultrasonic probe for which the method of the present invention is applied.
Figure 58:
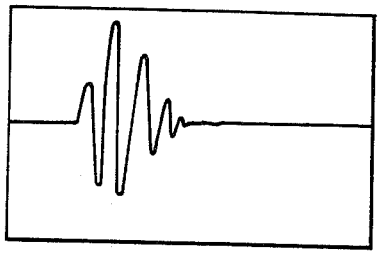

The results of measurement of the impedance characteristics and pulse characteristics of the ultrasonic probe thus connected to the cable are shown in FIG. 57 and FIG. 58, respectively.

The impedance characteristics were measured by a network analyzer (8505A, trade name, produced by HP), and the pulse characteristics determined by measuring the echo from the acryic block target in water by UTA-3 (trade name, produced by Aerotech) which was a standard pulser.

Figure 59:
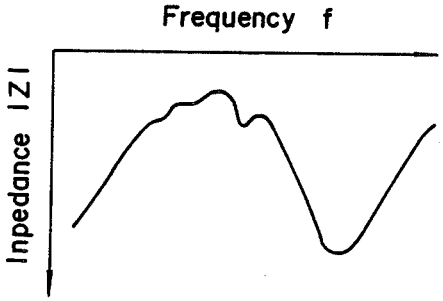
FIG. 59 and FIG. 60 are charts showing the impedance characteristic and the pulse echo characteristic of the ultrasonic probe for which the method of the prior art is applied.

Further, for comparison, the impedance characteristics and pulse characteristics of an ultrasonic probe for which the connecting method of the prior art was applied, namely an ultrasonic probe connected by use of a cable with A=B=20 cm in FIG. 43, were measured in the same manner as described above to obtain the results as shown in FIG. 59 and FIG. 60, respectively.

Figure 60:
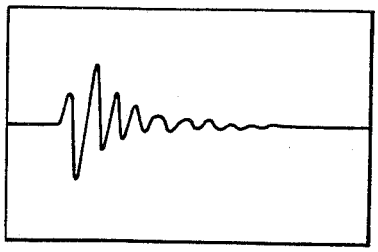

As a result, in the ultrasonic probe for which the connecting method of the prior art was applied, first with respect to impedance characteristics, unnecessary vibration was observed in the vicinity of the resonance point (FIG. 59), and also with respect to pulse characteristics, sensitivity was lowered, and deterioration in characteristics such as prolonged continuation of vibration was observed (FIG. 60).

As described in detail above, according to the present invention, not only breaking or short circuit of electrodes shaped in rectangular strips can be prevented, but also it becomes possible to connect lead wires with good reliability. Besides, not only cumbersomeness in registration of electrodes shaped in rectangular strips during lamination of polymeric piezoelectric members can be cancelled, but also acoustic-electrical coupling or cross-talk can be reduced.

According to the lead wire connecting method of the above, connection with solder, etc. in connecting electrodes for driving to lead wires can be easily done, whereby reliability and reproducibility at the lead wire connecting portions can be dramatically improved. Also, such phenomena as deterioration with lapse of time, peel-off, etc. at the connecting portions between the electrodes for driving and lead wires can be cancelled, and further deformation or breaking of wires at the electrode portions for driving, or depolarization phenomenon accompanied by heating to a high temperature of the polymeric piezoelectric member can be inhibited.

The polymeric piezoelectric ultrasonic probe, since the electrodes on both surfaces of the polymeric thin film are connected electrically to each other, has a very simple connecting structure with lead wires, and is also high in reliability, thus being very great in its commercial value.

Further, the polymeric piezoelectric ultrasonic probe has a structure which can afford lead take-out of electrodes for driving and lead take-out of the common electrode at one site, and therefore restricted spatially during lead take-out, and yet has the advantage of high reliability with respect to characteristics. Also, in the case of having a laminated structure having a plural number of common electrodes, stabilization of potential can be accomplished by electrically connecting the common electrodes to each other.

Further, since the electroconductive adhesive layers which are electrical connecting means for respective electrodes are formed intermittently, escape of the ordinary superfluous adhesive in the adhesion step can readily be effected, which is also very advantageous in carrying out the process.

We claim:

1. A polymeric piezoelectric ultrasonic probe, comprising:
   - a polymeric piezoelectric member;
   - a common electrode formed on one surface of said polymeric piezoelectric member;
   - at least one driving electrode disposed adjacent another surface of said polymeric piezoelectric member, opposite to said common electrode with said polymeric piezoelectric member being interposed therebetween,
   - said at least one driving electrode being formed on a polymeric thin film; and
   - an electrically insulating material disposed between said at least one driving electrode and said polymeric piezoelectric member.

2. A polymeric piezoelectric ultrasonic probe according to claim 1, further comprising a plurality of driving electrodes having end portions thereof having electrically conductive thick film portions, said probe further having lead wires and wherein said lead wires are connected to the polymeric piezoelectric ultrasonic probe at the electroconductive thick film portions formed at the end portions of said driving electrodes.

3. A polymeric piezoelectric ultrasonic probe according to claim 1, further comprising a lead take-out portion formed on said polymeric thin film, said lead take-out portion and said common electrode being electrically connected to each other through electroconductive adhesive layers formed intermittently in the longitudinal direction of said lead take-out portion.

4. A polymeric piezoelectric ultrasonic probe according to claim 1 further comprising another common electrode electrically connected to the first common electrode through electroconductive adhesive layers formed intermittently at the end portions of said first and another common electrodes.

5. A polymeric piezoelectric ultrasonic probe according to claim 2, wherein a plurality of driving electrodes are provided on opposed surfaces of said polymeric thin film and said probe further comprises means for electrically connecting the driving electrodes to each other in a region for connecting lead wires for said driving electrodes.

6. A polymeric piezoelectric ultrasonic probe according to claim 5, wherein said means electrically connecting consists of thru-holes having electroconductive material layers formed therein said thru-holes connecting electrically the driving electrodes on said opposed surfaces to each other.

7. A polymeric piezoelectric ultrasonic probe according to claim 5, wherein said plurality of driving electrodes are in the shape of rectangular strips.

8. A polymeric piezoelectric ultrasonic probe according to claim 1, wherein end portions of said polymeric piezoelectric member along the longitudinal direction of said driving electrodes extend beyond end portions of said common electrode.

9. A polymeric piezoelectric ultrasonic probe according to claim 2, wherein said plurality of driving electrodes are in the shape of rectangular strips.

10. A polymeric piezoelectric ultrasonic probe according to claim 1, further comprising a plurality of polymeric piezoelectric members laminated on one another with adjacent polarizing axes being opposed to each other with polymeric thin films having driving electrodes previously formed thereon being interposed therebetween, and a first common electrode provided on an acoustic actuating side of the piezoelectric members and a second common electrode provided on an acoustic non-actuating side thereof, wherein said first common electrode and said second common electrode have the same shape, and said common electrodes and driving electrodes are arranged in non-protruded positions from each other as viewed from the laminated direction.

11. a polymeric piezoelectric ultrasonic probe according to claim 1, further comprising a plurality of polymeric piezoelectric members laminated on one another with adjacent polarizing axes being opposed to each other with polymeric thin films having driving electrodes previously formed thereon being interposed therebetween, and a first common electrode provided on an acoustic actuating side of the piezoelectric members and a second common electrode provided on an acoustic non-actuating side thereof, wherein the size of said driving electrodes in the longitudinal direction is larger than the length in the direction parallel to the longitudinal direction of said first common electrode and second common electrode.

12. A polymeric piezoelectric ultrasonic probe according to claim 1, wherein said polymeric piezoelectric member operates as a vibrator, and wherein a toroidal type inductor is used as an inductor for impedance matching between a power source for said ultrasonic probe and said vibrator.

13. A polymeric piezoelectric ultrasonic probe according to claim 1, wherein said polymeric piezoelectric member operates as a vibrator and said probe further comprises an inductor and an electrical equivalent circuit in the vicinity of a central frequency of said vibrator is represented by a series circuit of a resistance and a capacity, and an inductive reactance equal in absolute value to the capacity reactance of said equivalent circuit is represented by $X_L$, said inductor has a reactance $X_0$ which is $0.6\ X_L < X_0 < 0.8\ X_L$, said inductor connected in series to said vibrator.

14. A polymeric piezoelectric ultrasonic probe according to claim 13, wherein said inductor comprises a plurality of drum type inductors existing adjacent one another for impedance matching between sending and receiving circuits said inductors arranged so as to have central axes thereof cross each other at right angles.

15. A polymeric piezoelectric ultrasonic probe according to claim 1, wherein said polymeric piezoelectric member operates as a vibrator, and wherein said probe further comprises, a coaxial cable consisting of a core wire; a core wire coating layer; an earth wire wound around the core wire coating layer; and a coating layer covered over the earth wire, the core wire coating layer at a tip end portion of the cable being exposed over a length of 3 cm or less, and the earth wire being taken out at a length of 3 cm or less.

16. A polymeric piezoelectric ultrasonic probe according to claim 1, wherein the polymeric piezoelectric member is selected from the group consisting of $PVF_2$, $PVF_2$.TrFE, polyvinylidene fluoride-ethylene fluoride copolymer, polyvinylidene cyanide, polyacrylonitrile copolymer and ferroelectric ceramic.

17. A polymeric piezoelectric ultrasonic probe according to claim 1, wherein the polymeric thin film is selected from the group consisting of polyester, polyethylene, polypropylene, polyimide, aromatic polyamide, polyether, polyvinyl chloride, $PVF_2$, $PVF_2$ type copolymer and polystyrene.

18. A polymeric piezoelectric ultrasonic probe according to claim 1, wherein the driving electrode is a metal selected from the group consisting of gold, silver, nickel and aluminum, or is formed of an electroconductive paint of said metal mixed with electroconductive powder.

* * * * *